US007541724B2

(12) United States Patent
Okabe et al.

(10) Patent No.: US 7,541,724 B2
(45) Date of Patent: Jun. 2, 2009

(54) SPARK PLUG REQUIRING LOW DISCHARGE VOLTAGE AND HAVING HIGH SELF-CLEANING CAPABILITY

(75) Inventors: Shinichi Okabe, Aichi-ken (JP); Ken Hanashi, Handa (JP)

(73) Assignees: DENSO Corporation, Kariya (JP); Nippon Soken, Inc., Nishio (JP)

( * ) Notice: Subject to any disclaimer, the term of this patent is extended or adjusted under 35 U.S.C. 154(b) by 459 days.

(21) Appl. No.: 11/395,543

(22) Filed: Apr. 3, 2006

(65) Prior Publication Data

US 2006/0220512 A1 Oct. 5, 2006

(30) Foreign Application Priority Data

Apr. 1, 2005 (JP) ..... 2005-106428

(51) Int. Cl.
*H01T 13/20* (2006.01)
*H01T 21/02* (2006.01)
*H01T 13/46* (2006.01)

(52) U.S. Cl. ..... 313/141; 313/11.5; 313/142

(58) Field of Classification Search ..... 313/141, 313/143

See application file for complete search history.

(56) References Cited

U.S. PATENT DOCUMENTS 6,552,476 B1 * 4/2003 Hanashi et al. ..... 313/141
6,707,237 B2 3/2004 Teramura et al.
7,221,078 B2 5/2007 Watanabe
2003/0193282 A1 10/2003 Shibata et al.
2005/0029915 A1 * 2/2005 Yorita et al. ..... 313/141

FOREIGN PATENT DOCUMENTS

| | | |
|---|---|---|
| DE | 38 72 027 | 4/1988 |
| DE | 699 00 064 | 9/1999 |
| DE | 10 2004 026 253 | 1/2005 |
| EP | 0 287 080 | 4/1988 |
| EP | 0 989 646 | 9/1999 |
| EP | 1 353 423 | 4/2003 |
| JP | 2004-006250 | 1/2004 |

OTHER PUBLICATIONS

German Search Report, dated May 30, 2008, issued in corresponding German Appln. No. 10 2006 000 152.4-23, with English translation.

* cited by examiner

*Primary Examiner*—Sikha Roy
*Assistant Examiner*—Tracie Y Green
(74) *Attorney, Agent, or Firm*—Nixon & Vanderhye, PC

(57) ABSTRACT

A spark plug according to the present invention includes a metal shell, an insulator retained in the metal shell, a center electrode secured in the insulator, and a ground electrode. The center electrode includes a base member and a thin member thinner the base member. The ground electrode includes a base member fixed to the metal shell and a protruding member that protrudes from the base member and has an end face with an inner and an outer edge. When the insulator is clean, sparks can be discharged between the thin member and the inner edge. When the insulator is fouled with carbon, sparks can be discharged between the base member and the outer edge to self-clean the insulator. Dimensional parameters and relationships are specified in the spark plug, so that the spark plug can induce spark discharges with a low discharge voltage while securing an excellent self-cleaning capability thereof.

17 Claims, 14 Drawing Sheets

FIG. 9A1
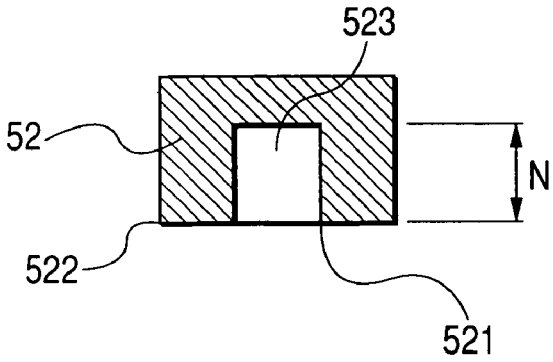
FIG. 9A2
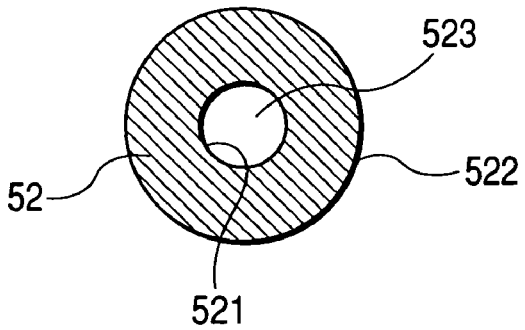
FIG. 9B1
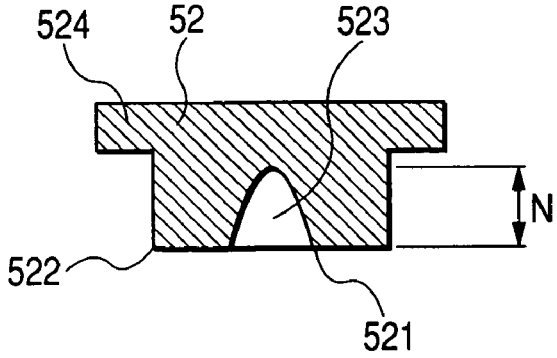
FIG. 9B2
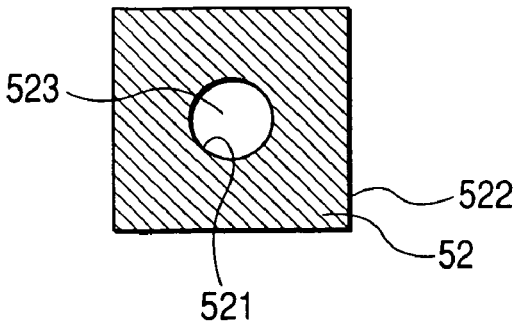

FIG. 9C1
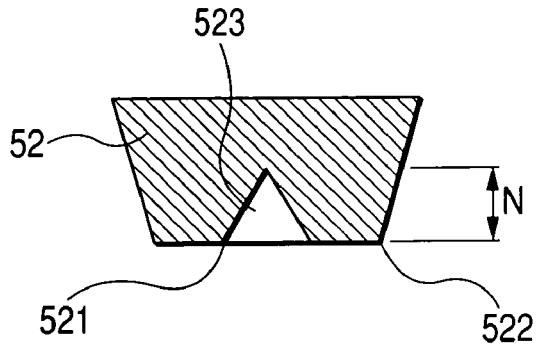
FIG. 9C2
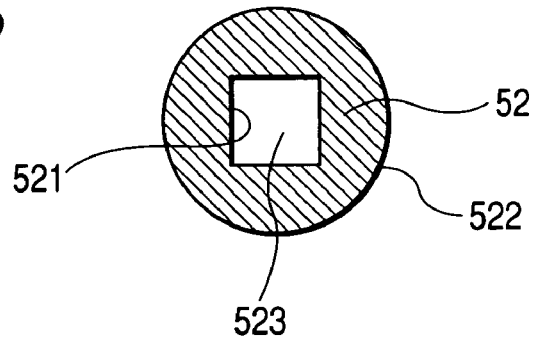
FIG. 9D1
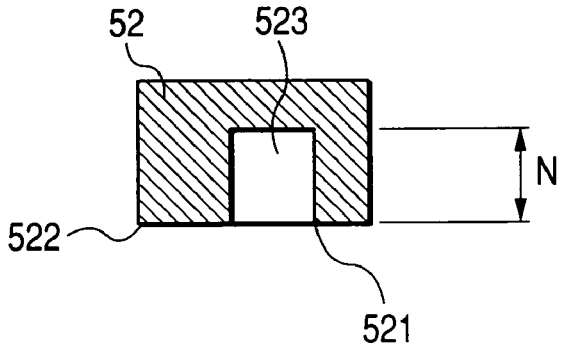
FIG. 9D2
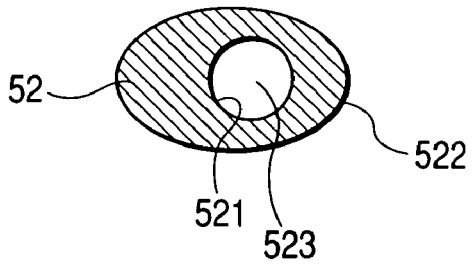

SPARK PLUG REQUIRING LOW DISCHARGE VOLTAGE AND HAVING HIGH SELF-CLEANING CAPABILITY

CROSS-REFERENCE TO RELATED APPLICATION

This application is based on and claims priority from Japanese Patent Application No. 2005-106428, filed on Apr. 1, 2005, the content of which is hereby incorporated by reference into this application.

BACKGROUND OF THE INVENTION

1. Technical Field of the Invention

The present invention relates generally to spark plugs for use in internal combustion engines of automobiles and cogeneration systems.

More particularly, the invention relates to a spark plug for an internal combustion engine which can induce spark discharges with a low discharge voltage and has an excellent self-cleaning capability.

2. Description of the Related Art

FIG. 19 shows a conventional spark plug 9 for an internal combustion engine of an automobile or a cogeneration system. As shown in the figure, the spark plug 9 includes an insulator 92, a center electrode 93, a metal shell 94, and a ground electrode 95. The center electrode 93 is secured in the insulator 92. The insulator 92 is retained in the metal shell 94 such that an end 1 thereof protrudes from the metal shell 94. The ground electrode 95 is fixed to the metal shell 94 and faces the center electrode 93 through a spark gap 91 in the longitudinal direction Z-Z of the spark plug 9.

In normal conditions of the spark plug 9, sparks can be discharged across the spark gap 91 by applying a discharge voltage (i.e., the voltage required to induce spark discharges) between the center and ground electrodes 93 and 95.

However, when the surface of the insulator 92 is fouled with carbon that is electrically conductive, the insulation resistance between the center and ground electrodes 93 and 95 will be decreased, thus making it difficult for the spark plug 9 to induce spark discharges across the spark gap 91.

Accordingly, it is desirable for the spark plug 9 to have a self-cleaning capability to clean the surface of the insulator 92 by burning off the carbon that has deposited on the surface.

To impart such a self-cleaning capability to the spark plug 9, according to an approach disclosed in Japanese Patent First Publication No. 2004-6250, the center electrode 93 is configured to include a base member 931 and a thin member 932. The base member 931 is fitted in a central bore 923 of the insulator 92 and has an end 933 that is positioned inside the central bore 923 in proximity to the end 921 of the insulator 92. The thin member 932 is thinner than the base member 931 and connected to the end 933 of the base member 931.

With such a configuration, when the surface of the insulator 92 is clean, spark discharges A can be induced between the thin member 932 of the center electrode 93 and a protruding member 952 of the ground electrode 95. On the other hand, when the surface of the insulator 92 is fouled with carbon, spark discharges B can be induced between the base member 931 of the center electrode 93 and the protruding member 952 of the ground electrode 95. The spark discharges B pass the inner surface 924 of the insulator 92 defining the central bore 923, thereby burning off the carbon that has deposited on the inner surface 924. Consequently, the spark plug 9 can be self-cleaned.

However, with the above configuration, there is a contradiction between enhancement of the self-cleaning capability and reduction of the discharge voltage of the spark plug 9.

More specifically, in recent years, direct injection engines and high compression ratio engines have been developed to meet the requirement of improving fuel economy.

In direct injection engines, it is difficult for fuel to vaporize due to the direct injection thereof into combustion chambers. As a consequence, when the spark plug 9 is used in a direct injection engine, it is easy for carbon to deposit on the surface of the insulator 92. Accordingly, the spark plug 9 is required to have a high self-cleaning capability.

To meet the above requirement, referring to FIG. 20, it is necessary for an end edge 953 of the protruding member 952 of the ground electrode 95 to be arranged as close to the inner surface 924 of the insulator 92 as possible. However, this arrangement causes, at the same time, the end edge 953 to get away from an end edge 934 of the thin member 932 of the center electrode 93, thereby increasing the discharge voltage of the spark plug 9.

On the other hand, when the spark plug 9 is used in a high compression ratio engine, it is easy for the discharge voltage of the spark plug 9 to be increased due to the high compression pressure. The increase in the discharge voltage of the spark plug 9 may cause dielectric breakdown of the insulator 92. Accordingly, it is required to reduce the discharge voltage of the spark plug 9.

To meet the above reduction requirement, referring to FIG. 21, it is necessary for the end edge 953 of the protruding member 952 of the ground electrode 95 to be arranged as close to the end edge 934 of the thin member 932 of the center electrode 93 as possible. However, this arrangement may cause, at the same time, the end edge 953 to get away from the inner surface 924 of the insulator 92, thereby lowering the self-cleaning capability of the spark plug 9.

SUMMARY OF THE INVENTION

The present invention has been made in view of the above-mentioned circumstances.

It is, therefore, a primary object of the present invention to provide a spark plug for an internal combustion engine which has an improved structure that enables the spark plug to induce spark discharges with a low discharge voltage while securing an excellent self-cleaning capability of the spark plug.

According to the present invention, a spark plug for an internal combustion engine includes a metal shell, an insulator, a center electrode, and a ground electrode.

The insulator is retained in the metal shell. The insulator has an end, which protrudes from the metal shell, and a bore that extends in the longitudinal direction of the insulator and opens at the end of the insulator to form an inner edge of the insulator.

The center electrode includes a base member and a thin member. The base member is fitted in the bore of the insulator and has an end that is positioned inside the bore of the insulator. The thin member is thinner than the base member and joined to the end of the base member. The thin member has an axis and an end edge that is a given distance away from the end of the base member in the axial direction of the thin member.

The ground electrode includes a base member fixed to the metal shell and a protruding member joined to the base member. The protruding member protrudes from the surface of the base member and has an end face that faces the thin member of the center electrode through a spark gap. The end face of the protruding member has an inner and an outer edge. The inner edge is positioned closer to the axis of the thin member of the center electrode than the outer edge.

In the spark plug, the following dimensional relationships are specified:

$$0.7\times R3\leqq R1,$$

$$0.5\times R4\leqq R2\leqq 1.2\times R4,$$

$$L\leqq G1\leqq 1.2\times L,$$

$$G1<G2+H, \text{ and}$$

$$G2/G1\leqq 1.5,$$

where, R1 is the distance between the axis of the thin member of the center electrode and the inner edge of the protruding member of the ground electrode in the radial direction of the thin member, R2 is the distance between the axis of the thin member of the center electrode and the outer edge of the protruding member of the ground electrode in the radial direction of the thin member, R3 is a radius of the thin member of the center electrode, R4 is a radius of the bore of the insulator, G1 is the minimum distance between the end edge of the thin member of the center electrode and the inner edge of the protruding member of the ground electrode, G2 is the minimum distance between the inner edge of the insulator and the outer edge of the protruding member of the ground electrode, L is the distance between the thin member of the center electrode and the protruding member of the ground electrode in the axial direction of the thin member, and H is the distance between the end of the base member of the center electrode and the end of the insulator in the axial direction of the thin member of the center electrode.

With the above configuration, it is possible to dispose the inner edge of the protruding member of the ground electrode close to the end edge of the thin member of the center electrode while disposing the outer edge of the protruding member of the ground electrode close to the inner edge of the insulator.

Consequently, it becomes easy for the spark plug to discharge sparks, when the surface of the insulator is clean, between the inner edge of the protruding member of the ground electrode and the end edge of the thin member of the center electrode. Moreover, it also becomes easy for the spark plug to discharge sparks, when the surface of the insulator is fouled with carbon, between the outer edge of the protruding member of the ground electrode and the base member of the center electrode via the inner surface of the insulator defining the bore of the insulator.

Further, through specifying the dimensional relationships of $0.7\times R3\leqq R1$ and $L\leqq G1\leqq 1.2\times L$, it becomes possible to dispose the inner edge of the protruding member of the ground electrode sufficiently close to the end edge of the thin member of the center electrode, thereby enabling the spark plug to discharge sparks with a sufficiently low discharge voltage.

Moreover, through specifying the dimensional relationship of $0.5\times R4\leqq R2\leqq 1.2\times R4$, it becomes possible to dispose the outer edge of the protruding member of the ground electrode sufficiently close to the inner edge of the insulator, thereby enabling the spark plug to reliably self-clean the surface of the insulator when it is fouled with carbon.

Furthermore, through specifying the dimensional relationships of $G1<G2+H$ and $G2/G1\leqq 1.5$, it becomes possible for the spark plug to reliably discharge sparks, when the surface of the insulator is clean, with a low discharge voltage between the thin member of the center electrode and the protruding member of the ground electrode while preventing spark discharges between the base member of the center electrode and the protruding member of the ground electrode.

As a result, the spark plug according to the invention can reliably induce spark discharges with a sufficiently low discharge voltage while securing an excellent self-cleaning capability thereof.

Preferably, in the spark plug according to the invention, the protruding member of the ground electrode occupies an angular range of at least 120° about the axis of the thin member of the center electrode.

It is preferable that in the spark plug according to the invention, $0.7\times R3\leqq R2$ and $0.5\times R4\leqq R1\leqq 1.2\times R4$.

Preferably, in the spark plug according to the invention, the protruding member of the ground electrode has a tubular shape to form the inner edge at the inner circumference of the end face of the protruding member and the outer edge at the outer circumference of the same.

In the spark plug according to the invention, the ground electrode may further include at least one protruding member having an end face that faces the thin member of the center electrode through the spark gap and has an outer edge and an inner edge positioned closer to the axis of the thin member of the center electrode than the outer edge.

It is preferable that in the spark plug according to the invention, $G2/G1\leqq 1.3$.

It is also preferable that in the spark plug according to the invention, $0.5\times H\leqq(R4-R3)$.

It is also preferable that in the spark plug according to the invention, $0.1\text{ mm}\leqq(R2-R1)\leqq 0.5\text{ mm}$.

Preferably, in the spark plug according to the invention, the protruding member of the ground electrode protrudes at least 0.3 mm from the surface of the base member of the ground electrode.

In the spark plug according to the invention, the base member of the center electrode may have an end portion that is thicker than the thin member of the center electrode and thinner than the bore of the insulator and includes the end of the base member to which the thin member is joined.

Preferable, in the spark plug according to the invention, the thin member of the center electrode is made of a noble metal, has a cross-sectional area perpendicular to the axis thereof in a range of 0.07 to 1.13 $mm^2$, and protrudes 0.3 to 1.5 mm from the end of the base member of the center electrode.

It is preferable that the above noble metal is an Ir-based alloy that contains Ir in an amount of not less than 50% by weight and at least one additive and has a melting point of not lower than 2000° C.

Further, the above additive is preferably selected from Pt, Rh, Ni, W, Pd, Ru, Re, Al, $Al_2O_3$, Y, and $Y_2O_3$.

Preferably, in the spark plug according to the invention, the protruding member of the ground electrode is made of a Pt-based alloy that contains Pt in an amount of not less than 50% by weight and at least one additive and has a melting point of not lower than 1500° C.

Further, the above additive contained in the Pt-based alloy is preferably selected from Ir, Rh, Ni, W, Pd, Ru, and Re.

Preferably, in the spark plug according to the invention, the thin member of the center electrode protrudes from the end of the insulator.

BRIEF DESCRIPTION OF THE DRAWINGS

The present invention will be understood more fully from the detailed description given hereinafter and from the accompanying drawings of the preferred embodiments of the invention, which, however, should not be taken to limit the invention to the specific embodiments but are for the purpose of explanation and understanding only.

In the accompanying drawings:

FIG. 9A1-9D2 are cross-sectional views illustrating various shapes which a ground electrode protruding member of a spark plug according to the invention may have;

DESCRIPTION OF THE PREFERRED EMBODIMENTS

Figure 1:
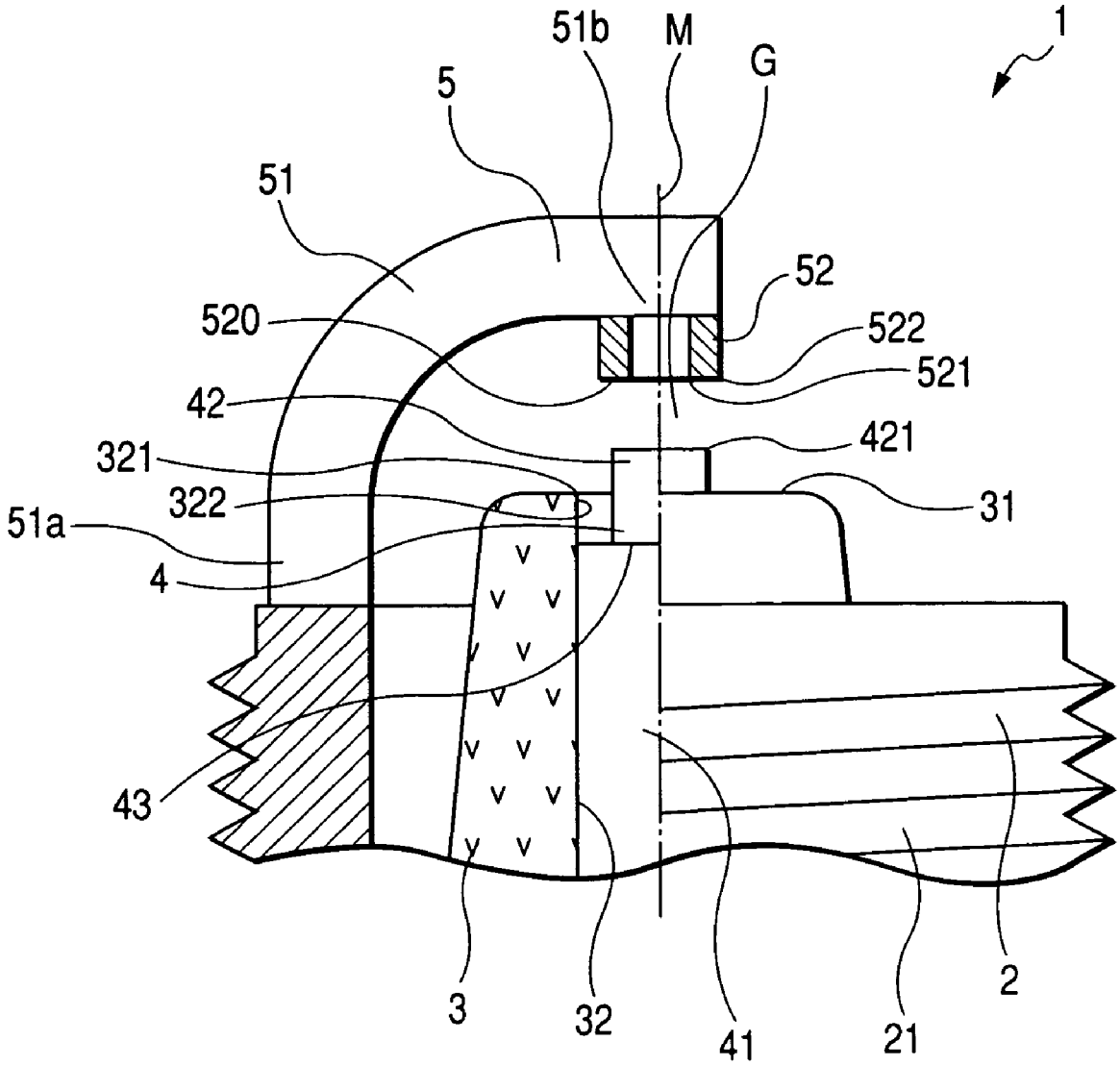
FIG. 1 is a partially cross-sectional side view showing an end portion of a spark plug according to the first embodiment of the invention.

The preferred embodiments of the present invention will be described hereinafter with reference to FIGS. 1-18.

It should be noted that, for the sake of clarity and understanding, identical components having identical functions in different embodiments of the invention have been marked, where possible, with the same reference numerals in each of the figures.

First Embodiment

FIG. 1 shows the overall structure of a spark plug 1 according to the first embodiment of the invention.

The spark plug 1 is designed for use in an internal combustion engine of an automobile or a cogeneration system. More specifically, the spark plug 1 is designed to ignite the air-fuel mixture within a combustion chamber of the engine.

As shown in FIG. 1, the spark plug 1 includes a tubular metal shell 2, an insulator 3, a center electrode 4, and a ground electrode 5.

The tubular metal shell 2 has a male threaded portion 21 on an outer periphery thereof, through which the spark plug 1 is to be installed in the combustion chamber of the engine. The metal shell 2 is made of a conductive metal material, such as low-carbon steel.

The insulator 3 is retained in the metal shell 2 such that an end 31 thereof protrudes from the metal shell 2. The insulator 3 has a central bore 32 that extends in the axial direction of the insulator 3 and opens at the end 31 to form an inner edge 321 of the insulator 3. The insulator 3 is made of a ceramic material, such as alumina ($Al_2O_3$).

The center electrode 4 is secured in the central bore 32 of the insulator 3, so that it is electrically isolated from the metal shell 2. The center electrode 4 includes a base member 41 and a thin member 42.

The base member 41 is fitted in the central bore 32 of the insulator 3 and has an end 43 that is positioned inside the central bore 32 in proximity to the end 31 of the insulator 3.

The base member 41 may be made of a highly heat conductive metal material such as Cu as the core material and a highly heat-resistant, corrosion-resistant metal material such as a Ni-based alloy as the cladding material.

The thin member 42 is thinner than the base member 41 and cylindrical in shape. The thin member 42 is joined to the end 43 of the base member 41 by, for example, laser welding. The thin member 42 protrudes from the end 31 of the insulator 3, so that an end edge 421 of the thin member 42 is positioned outside the central bore 32 of the insulator 3.

The thin member 42 is made, preferably, of an Ir-based alloy which contains Ir in an amount of not less than 50% by weight and at least one additive and has a melting point of not lower than 2000° C. The additive is, preferably, selected from Pt, Rh, Ni, W, Pd, Ru, Re, Al, $Al_2O_3$, Y, and $Y_2O_3$.

The ground electrode 5 includes a base member 51 and a protruding member 52.

The base member 51 is L-shaped and made, for example, of a Ni-based alloy. The base member 51 has a base end portion 51*a* fixed to the metal shell 2 and a tip end portion 51*b* aligned with the thin member 42 of the center electrode 4 in the axial direction of the thin member 42.

The protruding member 52 is joined to the tip end portion 51*b* of the base member 51 by, for example, laser welding such that the protruding member 52 faces the thin member 42 of the center electrode 4 through a spark gap G in the axial direction of the thin member 42.

Figure 2:
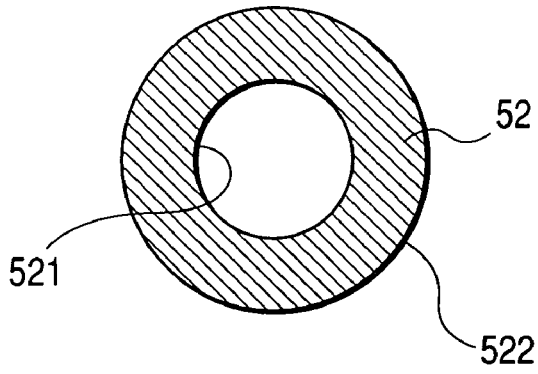
FIG. 2 is a cross-sectional view of a ground electrode protruding member of the spark plug of FIG. 1.

Referring further to FIG. 2, the protruding member 52 is shaped in a cylindrical tube and has an annular end face 520 facing the thin member 42 of the center electrode 4. The protruding member 52 accordingly has a circular inner edge 521 formed at the inner circumference of the annular end face 520 and a circular outer edge 522 formed at the outer circumference of the same.

The protruding member 52 is so positioned with respect to the thin member 42 of the center electrode 4 that the axis (not shown) of the protruding member 52 coincides with the axis M of the thin member 42. Accordingly, the protruding member 52 occupies an angular range of 360° about the axis M of the thin member 42 and the inner edge 521 is closer to the axis M than the outer edge 522

The protruding member 52 is made, preferably, of a Pt-based alloy which contains Pt in an amount of not less than 50% by weight and at least one additive and has a melting point of not lower than 1500° C. The additive is, preferably, selected from Ir, Rh, Ni, W, Pd, Ru, and Re.

Figure 3:
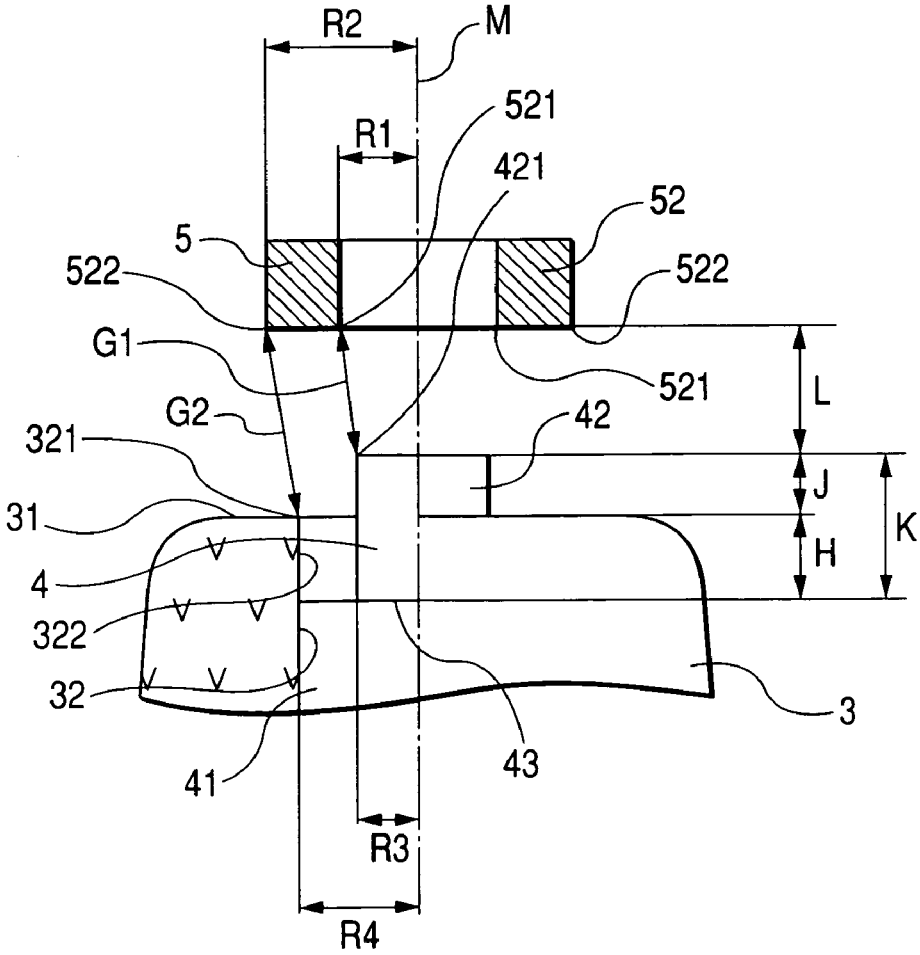
FIG. 3 is a partially cross-sectional side view illustrating dimensional parameters in the spark plug of FIG. 1.
Figure 4:
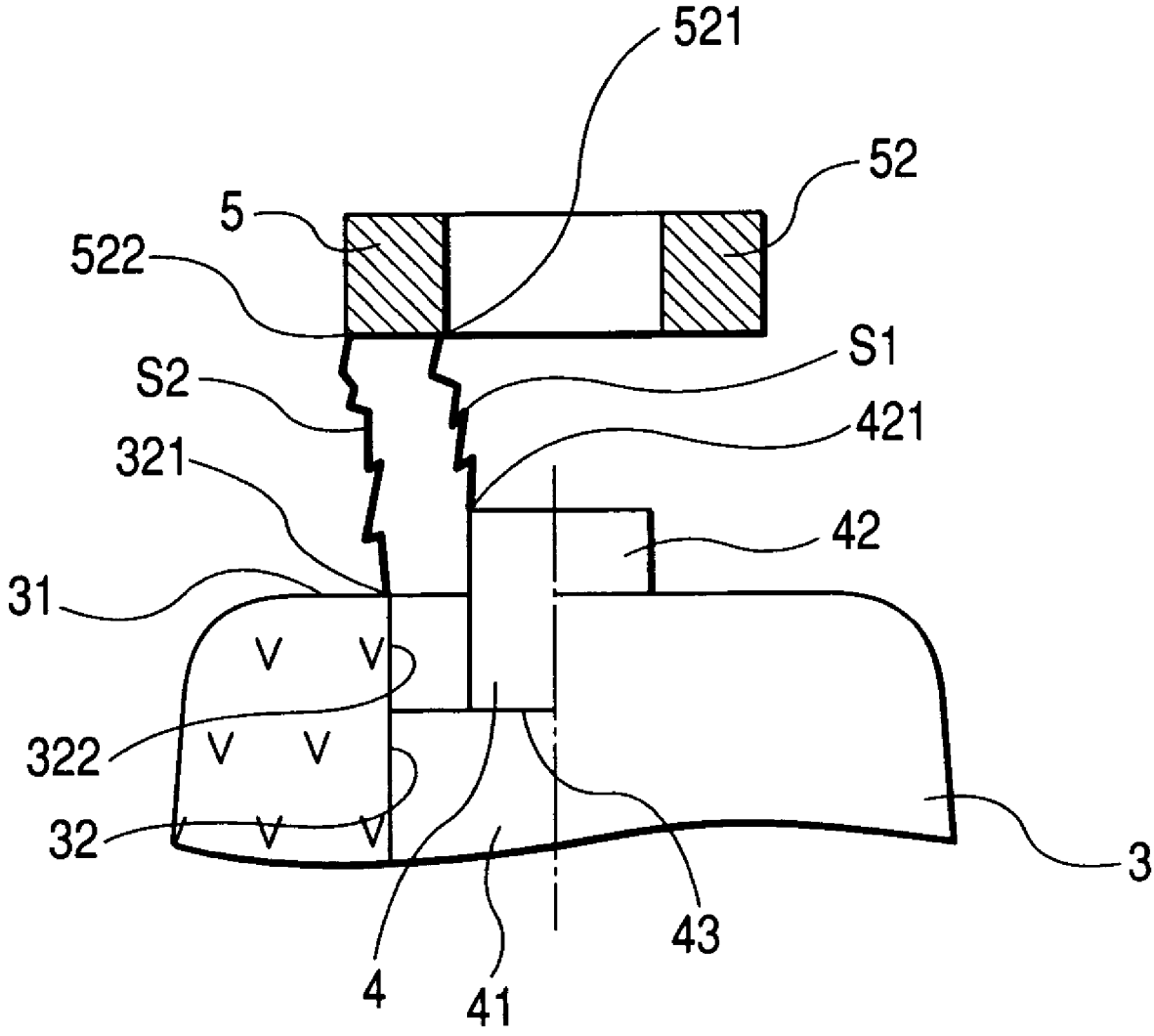
FIG. 4 is a schematic view illustrating two different desirable spark discharges made in the spark plug of FIG. 1.

After having described the overall structure of the spark plug 1, dimensional relationships, which are critical to the performance of the spark plug 1, will be described hereinafter with reference to FIG. 3.

In the spark plug 1, the following dimensional relationships are satisfied:

$$0.7\times R3\leqq R1\text{ , and}$$

$$0.5\times R4\leqq R2\leqq 1.2\times R4,$$

where, R1 is the distance from the axis M of the thin member 42 of the center electrode 4 to the inner edge 521 of the protruding ember 52 of the ground electrode 5 in the radial direction of the thin member 42, R2 is the distance from the axis M to the outer edge 522 of the protruding member 52 in the radial direction, R3 is the radius of the thin member 42, and R4 is the radius of the central bore 32 of the insulator 3 at the end 31 of the insulator 3.

In the spark plug 1, the following dimensional relationships are also satisfied:

$$L\leqq G1\leqq 1.2\times L,$$

$$G1<G2+H,\text{ and}$$

$$G2/G1\leqq 1.5,$$

where, G1 is the minimum distance between the end edge 421 of the thin member 42 of the center electrode 4 and the inner edge 521 of the protruding member 52 of the ground electrode 5, G2 is the minimum distance between the inner edge 321 of the insulator 3 and the outer edge 522 of the protruding member 52, L is the distance between the thin member 42 of the center electrode 4 and the protruding member 52 of the ground electrode 5 in the axial direction of the thin member 42, and H is the distance between the end 43 of the base member 41 of the center electrode 4 and the end 31 of the insulator 3 in the axial direction of the thin member 42.

Further, in the spark plug 1, the following dimensional relationships are preferably satisfied:

$$0.7\times R3\leqq R2;$$

$$0.5\times R4\leqq R1\leqq 1.2\times R4;$$

$$G2/G1\leqq 1.3;$$

$$0.5\times H\leqq (R4-R3),\text{ and}$$

$$0.1\text{ mm}\leqq (R2-R1)\leqq 0.5\text{ mm}.$$

Furthermore, in the spark plug 1, the protruding member 52 of the ground electrode 5 protrudes at least 0.3 mm from the surface of the tip end portion 51*b* of the base member 51.

In the spark plug 1, the thin member 42 of the center electrode 4 has a cross-sectional area perpendicular to the axis M thereof in a range of 0.07 to 1.13 $mm^2$ and a protruding height K, which represents the distance between the end edge 421 of the thin member 42 and the end 43 of the base member 41 of the center electrode 4 in the axial direction of the thin member 42, in a range of 0.3 to 1.5 mm.

In the spark plug 1, the thin member 42 of the center electrode 4 has another protruding height J, which represents the distance between the end edge 421 of the thin member 42 and the end 31 of the insulator 3 in the axial direction of the thin member 42, not less than zero. In other words, the thin member 42 protrudes from the end 31 of the insulator 3.

The above-described spark plug 1 according to the-present embodiment has the following advantages.

In the spark plug 1, the protruding member 52 of the ground electrode 5 is so configured to have the inner and outer edges 521 and 522.

With this configuration, it is easy for the spark plug 1 to discharge sparks between the inner edge 521 and the thin member 42 of the center electrode 4 when the surface of the insulator 3 is clean and between the outer edge 522 and the base member 41 of the center electrode 4 when the surface of the insulator 3 is fouled with carbon.

More specifically, with the above configuration, it is possible to dispose the inner edge 521 close to the thin member 42 of the center electrode 4 while disposing the outer edge 522 close to the inner edge 321 of the insulator 3. Consequently, it becomes easy for the spark plug 1 to discharge sparks, when the surface of the insulator 3 is clean, between the inner edge 521 and the end edge 421 of the thin member 42 of the center electrode 4, as indicated by the line S1 in FIG. 4. Moreover, it also becomes easy for the spark plug 1 to discharge sparks, when the surface of the insulator 3 is fouled with carbon, between the outer edge 522 and the base member 41 of the center electrode 4 via the inner surface 322 of the insulator 3 defining the central bore 32, as indicated by the line S2 in FIG.4.

As a result, the spark plug 1 can induce spark discharges with a low discharge voltage and can self-clean the insulator 3 thereof when it is fouled with carbon.

In the spark plug 1, the dimensional relationships of 0.7×R3≦R1 and L≦G1≦1.2×L are specified.

Specifying those relationships, it is possible to dispose the inner edge 521 of the protruding member 52 of the ground electrode 5 sufficiently close to the end edge 421 of the thin member 42 of the center electrode 4, thereby enabling the spark plug 1 to discharge sparks with a sufficiently low discharge voltage.

In the spark plug 1, the dimensional relationship of 0.5×R4≦R2≦1.2×R4 is also specified.

Specifying this relationship, it is possible to dispose the outer edge 522 of the protruding member 52 of the ground electrode 5 sufficiently close to the inner edge 321 of the insulator 3. Consequently, when the surface of the insulator 3 is fouled with carbon, the spark plug 1 can reliably discharge sparks between the outer edge 522 and the base member 41 of the center electrode 4 along the inner surface 322 of the insulator 3, thereby self-cleaning the surface of the insulator 3 through burning off the carbon having deposited on the surface.

In the spark plug 1, the dimensional relationships of G1<G2+H and G2/G1≦1.5 are also specified.

Specifying those relationships, it is possible for the spark plug 1 to reliably discharge sparks, when the surface of the insulator 3 is clean, with a low discharge voltage between the thin member 42 of the center electrode 4 and the protruding member 52 of the ground electrode 5, but not between the base member 41 of the center electrode 4 and the protruding member 52.

In the spark plug 1, the protruding member 52 of the ground electrode 5 is so formed to occupy the angular range of 360° (i.e., the entire circumference) about the axis M of the thin member 42 of the center electrode 5.

With this formation, it is possible for the spark plug 1 to reliably burn off the carbon, which has deposited on the surface of the insulator 3, over the entire circumference of the surface, thereby securing a high self-cleaning capability thereof.

Moreover, in the spark plug 1, the dimensional relationships of 0.7×R3≦R2 and 0.5×R4≦R1≦1.2×R4 are further specified.

Consequently, when the surface of the insulator 3 is clean, the spark plug 1 can discharge sparks not only between the thin member 42 of the center electrode 4 and the inner edge 521 of the protruding member 52 of the ground electrode 5 but also between the thin member 42 and the outer edge 522 of the protruding member 52, thereby further lowering the discharge voltage and enhancing the ignition capability thereof (i.e., the capability of the spark plug 1 to ignite the air-fuel mixture). Moreover, when the surface of the insulator 3 is fouled with carbon, the spark plug 1 can discharge sparks not only between the inner edge 321 of the insulator 3 and the outer edge 522 of the protruding member 52 of the ground electrode 5 but also between the inner edge 321 and the inner edge 521 of the protruding member 52, thereby enhancing the self-cleaning capability thereof.

In the spark plug 1, the protruding member 52 of the ground electrode 5 is so formed to have a cylindrical tube shape and thus the circular inner and outer edges 521 and 522.

With this formation, both the inner and outer edges 521 and 522 can occupy the full angular range (i.e., 360°) about the center electrode 4, thereby minimizing the discharge voltage and maximizing the self-cleaning capability of the spark plug 1.

In the spark plug 1, the dimensional relationship of G2/G≦1.3 is further specified.

Specifying this relationship, when the surface of the 1o insulator 3 is clean, the spark plug 1 can discharge sparks not only between the thin member 42 of the center electrode 4 and the inner edge 521 of the protruding member 52 of the ground electrode 5 but also between the thin member 42 and the outer edge 522 of the protruding member 52, thereby further lowering the discharge voltage and enhancing the ignition capability thereof.

In the spark plug 1, the dimensional relationship of 0.5×H≦(R4−R3) is further specified.

Figure 5:
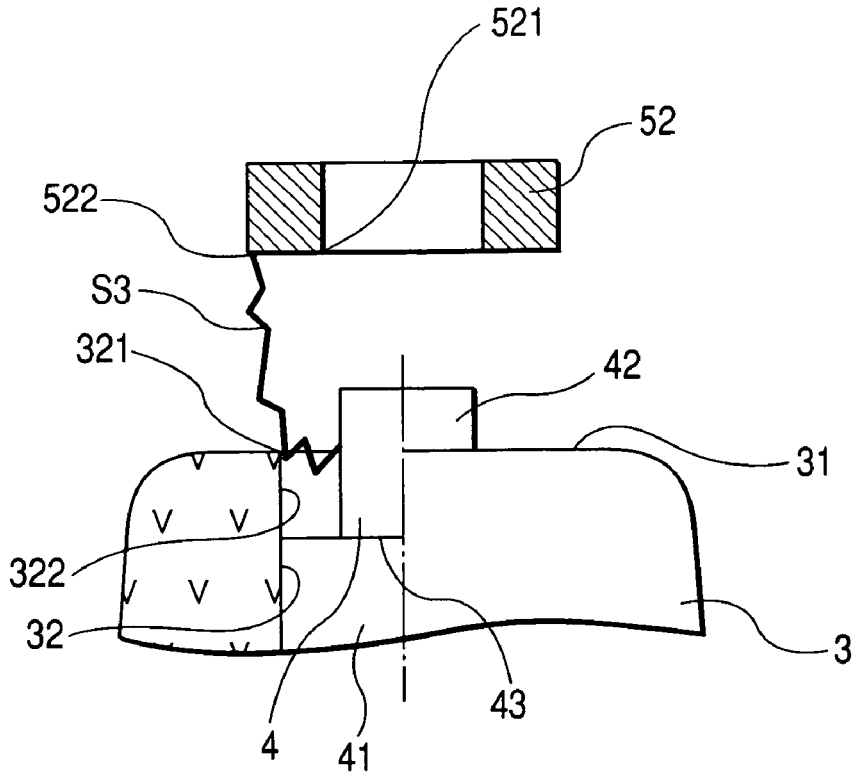
FIG. 5 is a schematic view illustrating an undesirable spark discharge made in the spark plug of FIG. 1.

Specifing this relationship, when the surface of the insulator 3 is fouled with carbon, it is possible to reliably prevent spark discharges which are made between the thin member 42 of the center electrode 4 and the outer edge 522 of the protruding member 52 of the ground electrode 5 via the inner edge 321 of the insulator 3 without passing the inner surface 322 of the insulator 3, as indicated by the line S3 in FIG. 5. Consequently, the spark plug 1 can reliably discharge sparks between the base member 42 of the center electrode 4 and the outer edge 522 of the protruding member 52 along the inner surface 322 of the insulator 3, as indicated by the line S2 in FIG. 4, thereby burning off the carbon on the surface of the insulator 3. As a result, the self-cleaning capability of the spark plug 1 is further enhanced.

In the spark plug 1, the dimensional relationship of 0.1 mm ≦(R2 −R1 )≦0.5 mm is further specified.

Specifying this relationship, it is possible to reliably secure the durability of the protruding member 52 of the ground electrode 5 as well as the ignition capability of the spark plug 1.

In the spark plug 1, the protruding member 52 of the ground electrode 5 is so configured to protrude at least 0.3 mm from the surface of the base member 51.

With this configuration, it is possible to reliably secure the ignition capability of the spark plug 1.

In addition, to secure the durability of the protruding member 52, the protruding height of the protruding member 52 from the surface of the base member 51 is, preferably, less than or equal to 1.1 mm.

In the spark plug 1, the thin member 42 of the center electrode 4 is so configured to protrude from the end 31 of the insulator 3 (i.e., J≧0).

With this configuration, it is possible to reliably secure the ignition capability of the spark plug 1.

In the spark plug 1, the thin member 42 of the center electrode 4 is so configured to have the cross-sectional area perpendicular to the axis M thereof in the range of 0.07 to 1.13 $mm^2$ and the protruding height K from the end 43 of the base member 41 in the range of 0.3 to 1.5 mm.

With this configuration, it is possible to reliably secure the durability of the thin member 42 of the center electrode 4 as well as the ignition capability of the spark plug 1.

In the spark plug 1, the thin member 42 of the center electrode 4 is made, preferably, of an Ir-based alloy that contains Ir in an amount of not less than 50% by weight and at least one additive and has a melting point of not lower than 2000° C. The additive is, preferably, selected from Pt, Rh, Ni, W, Pd, Ru, Re, Al, $Al_2O_3$, Y, and $Y_2O_3$.

Specifying the material of the thin member 42 as above, it is possible to reliably secure the durability of the thin member 42 as well as the ignition capability of the spark plug 1. As a result, it becomes possible to ensure a long service life and high reliability of the spark plug 1.

In the spark plug 1, the protruding member 52 of the ground electrode 5 is made, preferably, of a Pt-based alloy that contains Pt in an amount of not less than 50% by weight and at least one additive and has a melting point of not lower than 1500° C. The additive is, preferably, selected from Ir, Rh, Ni, W, Pd, Ru, and Re.

Specifying the material of the protruding member 52 as above, it is possible to reliably secure the durability of the protruding member 52 as well as the ignition capability of the spark plug 1. As a result, it becomes possible to ensure a long service life and high reliability of the spark plug 1.

Accordingly, the spark plug 1 according to the present embodiment can induce spark discharges with a low discharge voltage while securing a high self-cleaning capability thereof.

The above-described advantages of the spark plug 1 have been confirmed through the experiments to be described below.

EXPERIMENT 1

This experiment was conducted to determine the effect of R1 on the discharge voltage of the spark plug 1.

In the experiment, sample spark plugs, which had the same structure as the spark plug 1 but various R1 and L, were tested to measure the discharge voltages Vs thereof. In addition, in all of those sample spark plugs, R2 was 2.0 mm, R3 was 0.3 mm, R4 was 1.2 mm, H was 1.0 mm, and J was 0.2 mm.

Figure 19:
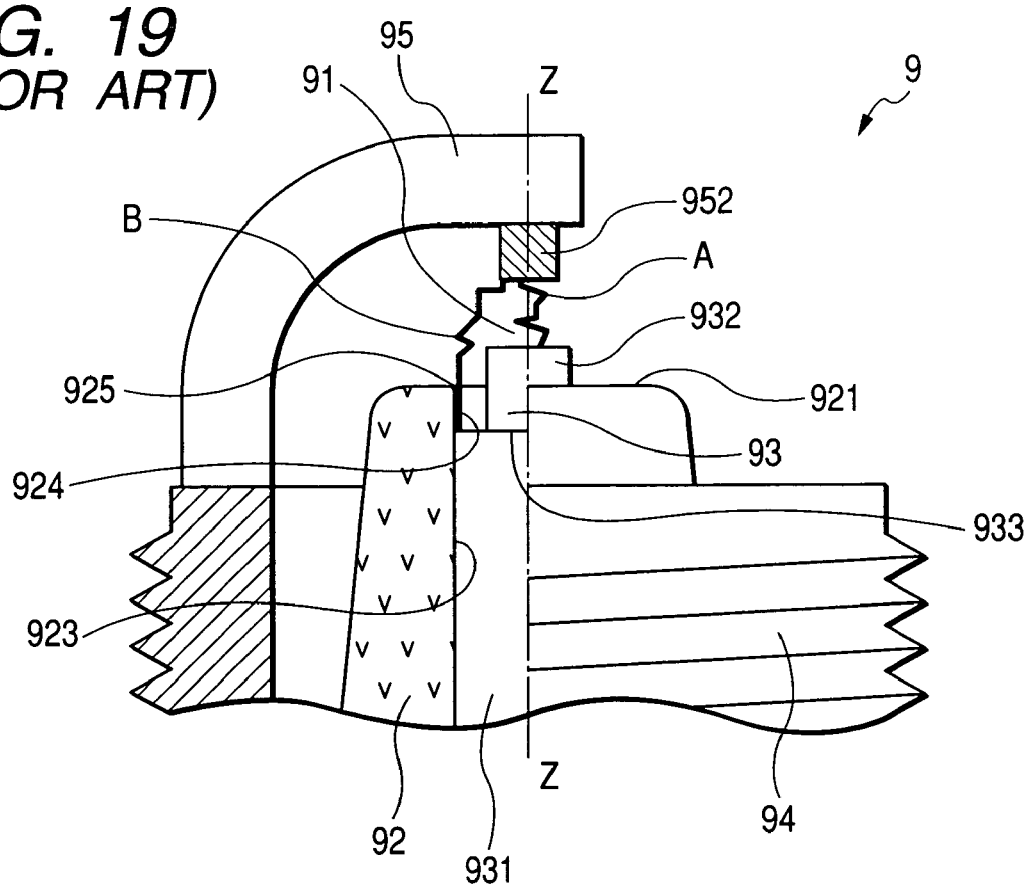
FIG. 19 (PRIOR ART)
FIG. 19 is a partially cross-sectional side view showing an end portion of a conventional spark plug.
Figure 20:
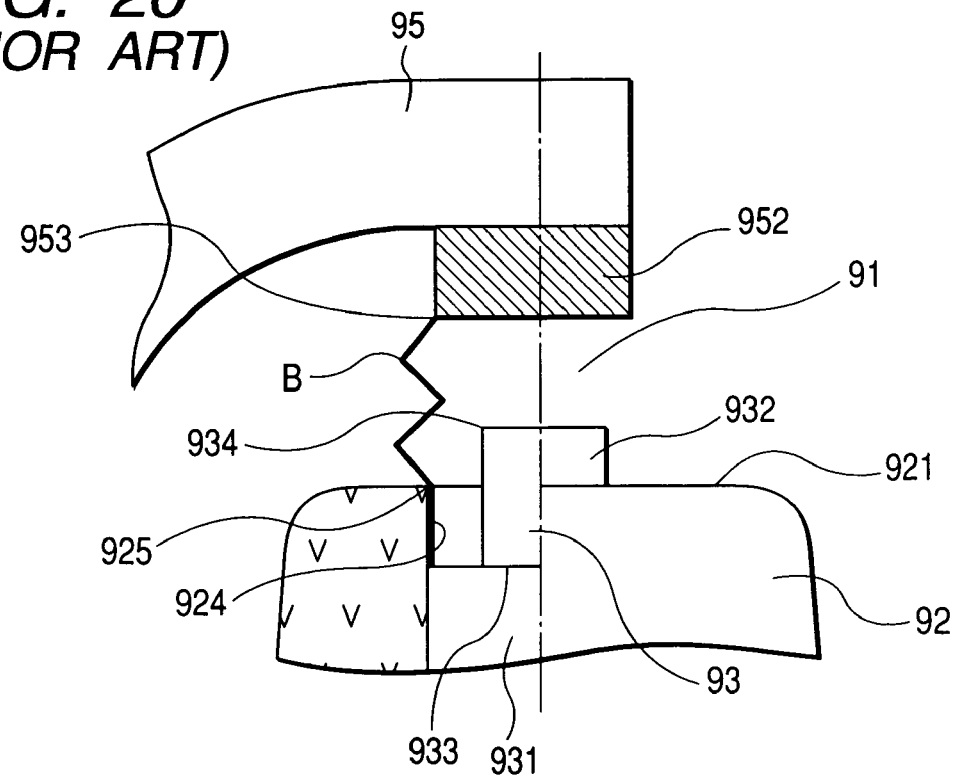
FIG. 20 (PRIOR ART)
FIGS. 20 and 21 are partially cross-sectional side views illustrating a contradiction between enhancement of the self-cleaning capability and reduction of the discharge voltage of the conventional spark plug of FIG. 19.
Figure 21:
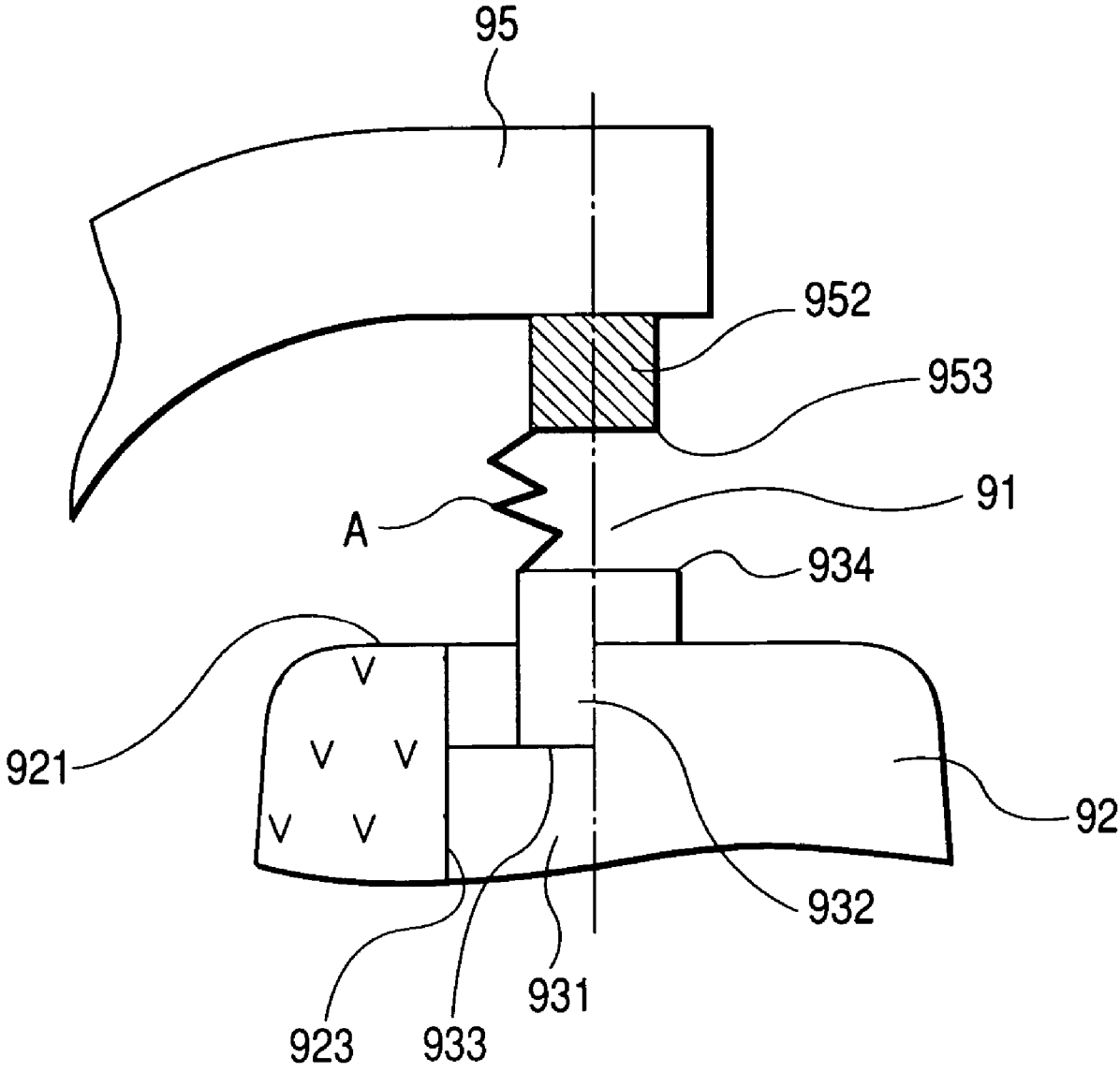
FIG. 21 (PRIOR ART)

Further, for the purpose of comparison, another sample spark plug, which had the same structure as the conventional spark plug 9 shown in FIG. 19, was also tested to measure the discharge voltage Vf thereof. In addition, in the sample spark plug, dimensional parameters except R1 had the same values as in the sample spark plugs with the same structure as the spark plug 1.

Figure 14A:
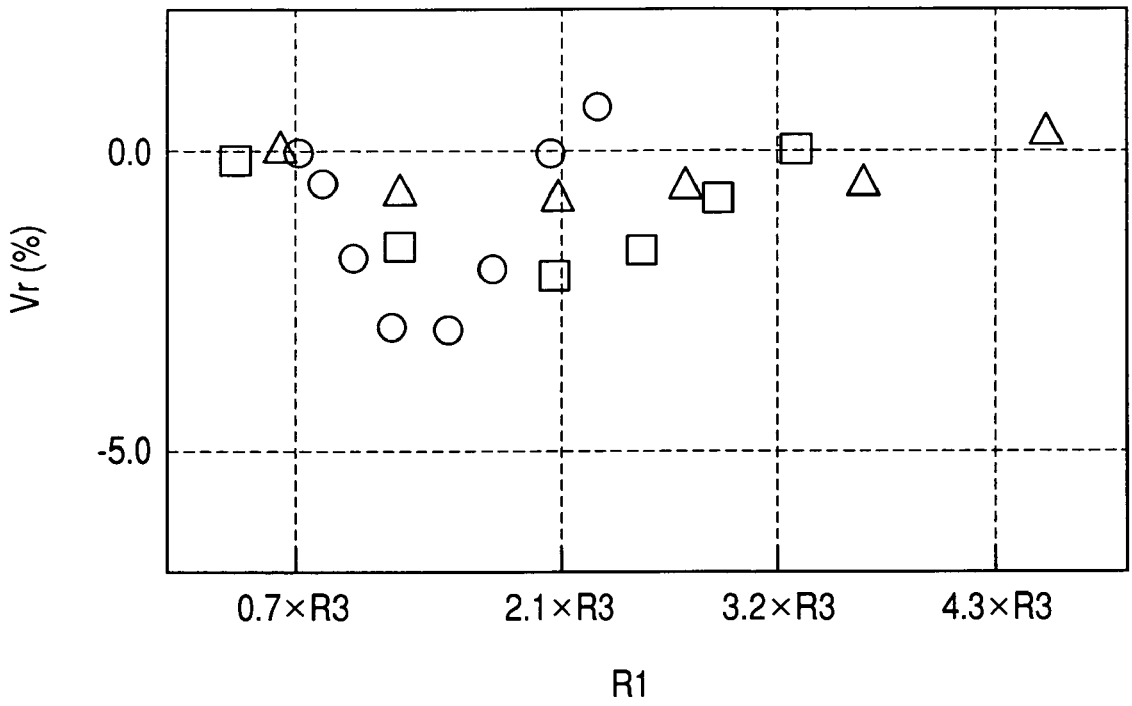
FIG. 14A is a graphical representation showing the relationship between thy dimensional parameter R1 and the discharge voltage reduction ratio Vr in the spark plug of FIG. 1.

FIG. 14A shows the test results, where the horizontal axis represents R1 , while the vertical one represents discharge voltage reduction ratio Vr. Further, in FIG. 14A, the plots of "○" indicate the results with the sample spark plugs in which L was 0.5 mm, the plots of "□" indicate those with the sample spark plugs in which L was 1.0 mm, and the plots of "Δ" indicate those with the sample spark plugs in which L was 1.5 mm. In addition, the discharge voltage reduction ratio Vr was calculated by using the following equation:

$$Vr(\%)=\{(Vs-Vf)/Vf\}\times 100 \quad (1)$$

It can be seen from FIG. 14A that when 0.7×R3≦R1 , Vr<0 regardless of L.

In other words, the discharge voltage of the spark plug 1 can be reduced through specifying the dimensional relationship of 0.7×R3≦R1.

Figure 14B:
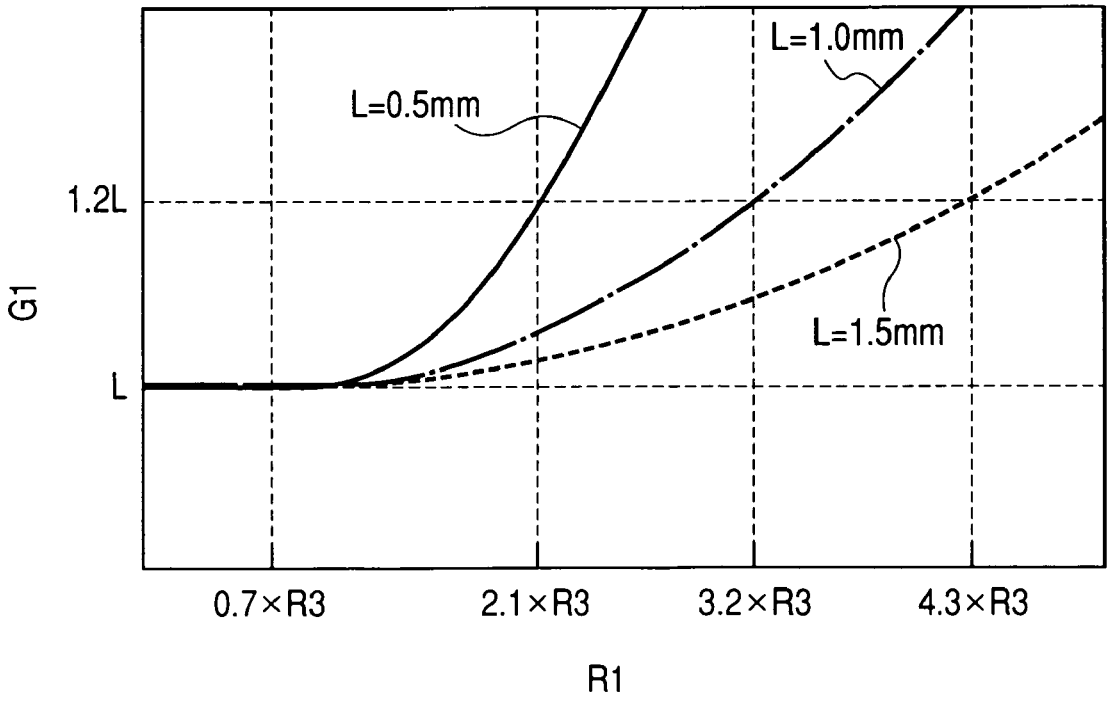
FIG. 14B is a graphical representation showing the relationship between the dimensional parameters R1 and G1 in the spark plug of FIG. 1.

In addition, there were dimensional relationships between R1 and G1 as shown in FIG. 14B in the sample spark plugs having the same structure as the spark plug 1.

It can be seen from FIGS. 14A and 14B that, when L≦1.5 mm and L≦G1≦1.2×L, Vr<0.

In other words, the discharge voltage of the spark plug 1 can also be reduced through specifying the dimensional relationship of L≦G1≦1.2×L.

EXPERIMENT 2

This experiment was conducted to determine the effect of R2 on the occurrence rate of "surface sparks" which are discharged between the outer edge 522 of the protruding member 52 of the ground electrode 5 and the base member 41 of the center electrode 4 along the inner surface 322 of the insulator 3.

Figure 15:
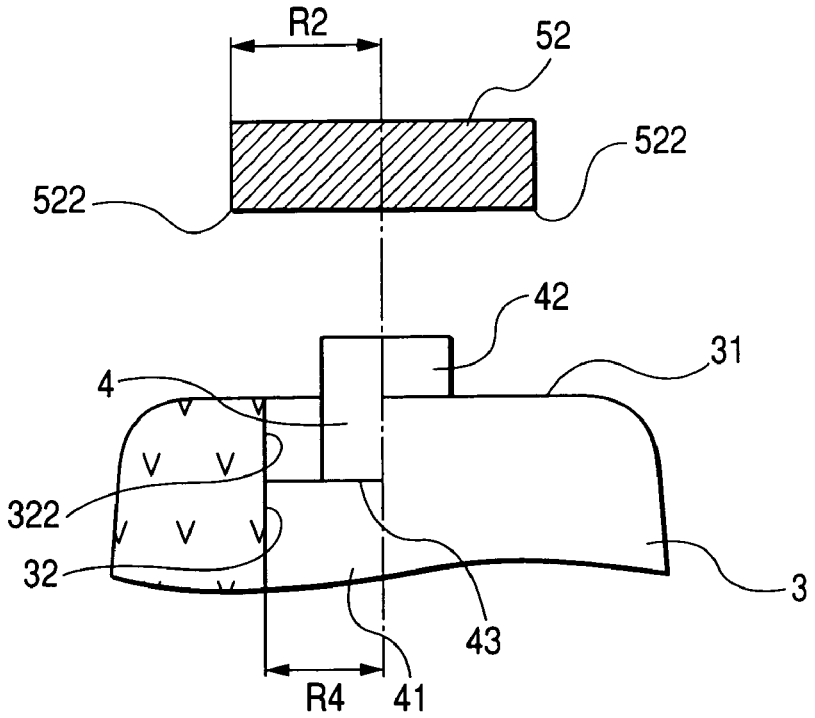
FIG. 15 is a partially cross-sectional side view showing an end portion of a sample spark plug tested in the Experiment 4 of the invention.

Sample spark plugs were fabricated which had almost the same structure as the spark plug 1 but a protruding member 52 different from that of the spark plug 1. More specifically, to specially determine the effect of R2 , the protruding members 52 of the sample spark plugs were so formed to have a solid rod shape, in other words, no inner edge, as shown in FIG. 15. At the same time, R2 was varied for those sample spark plugs. In addition, in all of those sample spark plugs, R3 was 0.3 mm, R4 was 1.2 mm, H was 1.0 mm, J was 0.2 mm, and L was 1.0 mm.

In this experiment, carbon was intentionally deposited, before test, on the end 31 and inner surface 322 of the insulator 3 of each of the sample spark plugs to make them foul.

Figure 16:
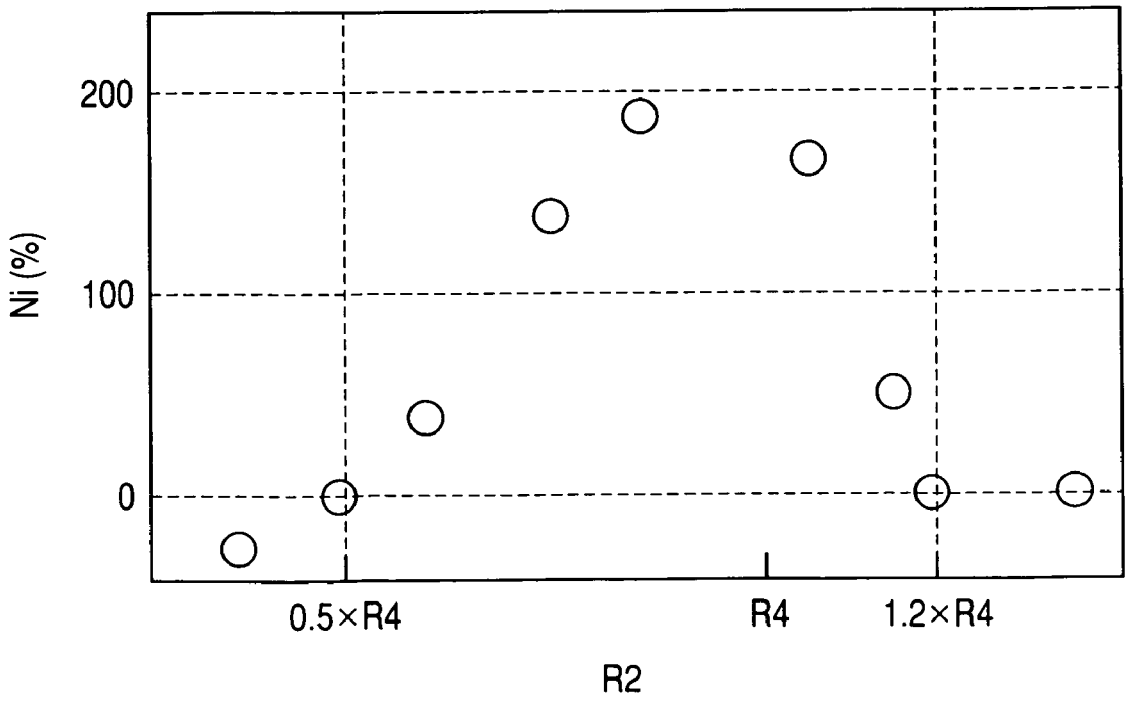
FIG. 16 is a graphical representation showing the relationship between the parameter R2 and the surface sparks increase ratio Ni in the spark plug of FIG. 1.

FIG. 16 shows the test results, where the horizontal axis represents R2 , while the vertical one represents surface sparks increase ratio Ni. For each of the sample spark plugs tested, Ni was calculated by using the following equation:

$$Ni(\%)=\{(Ns-Nf)/Nf\}\times 100 \quad (2),$$

where, Nf is the occurrence number of surface sparks per unit time in one of the sample spark plugs in which R2 was 2.0 mm, and Nf is the occurrence number of surface sparks in each of all the other sample spark plugs.

As seen from FIG. 16, when 0.5×R4≦R2≦1.2×R4, Ni≧0.

In other words, through specifying the dimensional relationship of 0.5×R4≦R2≦1.2×R4, the occurrence rate of surface sparks in the spark plug 1 can be increased and thus the self-cleaning capability of the spark plug 1 can be enhanced.

EXPERIMENT 3

This experiment was conducted to determine the effect of G2/G1 on the insulation resistance between the center electrode 4 and the ground electrode 5 of the spark plug 1.

Sample spark plugs were fabricated which had the same structure as the spark plug 1 but various G2/G1 . More specifically, G2 was 1.2 mm for all of those sample spark plugs, while G1 was varied by varying K. In addition, in all of those sample spark plugs, R1 was 0.3 mm, R2 was 1.2 mm, R3 was 0.3 mm, R4 was 1.2 mm, and H was 1.0 mm.

In this experiment, each of the sample spark plugs was tested under a cold fouling test condition specified in JIS-D-1606 for five cycles, and then the insulation resistance between the center electrode 4 and the ground electrode 5 thereof was measured.

Figure 17:
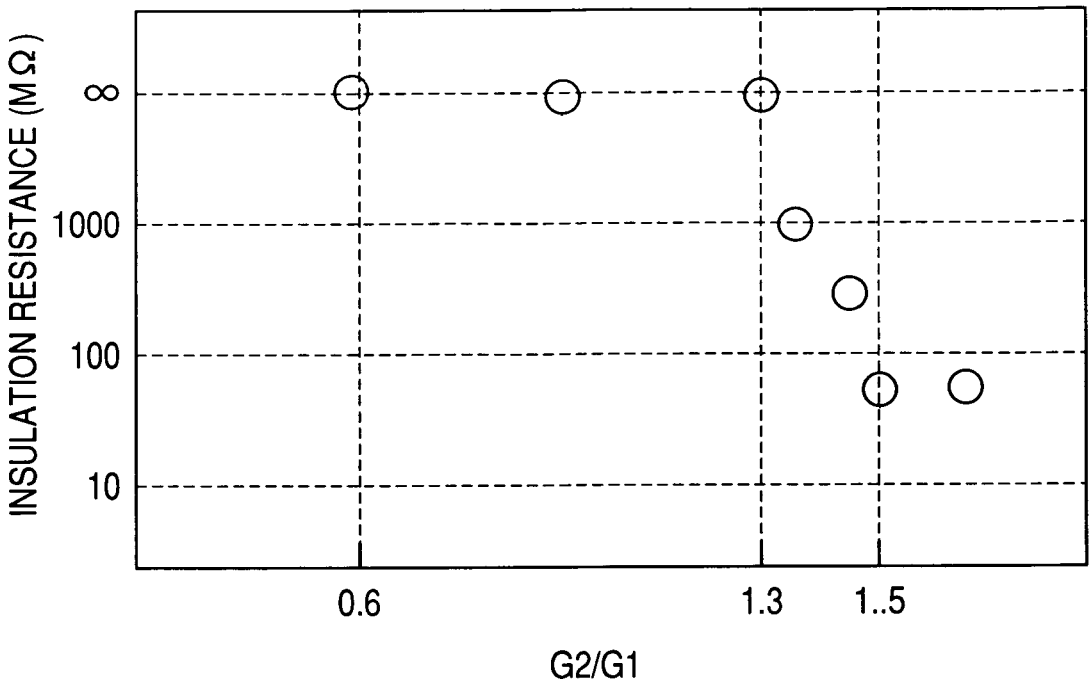
FIG. 17 is a graphical representation showing the relationship between the parameter G2/G1 and the insulation resistance in the spark plug of FIG. 1.

FIG. 17 shows the measurement results, where the horizontal axis represents G2/G1 , while the vertical one represents the insulation resistance.

As seen from FIG. 17, the insulation resistance was large when G2/G1≦1.5.

In other words, the self-cleaning capability of the spark plug 1 can be secured by specifying the dimensional relationship of G2/G1≦1.5.

Further, it can also be seen from FIG. 17 that the insulation resistance was particularly large when G2/G1≦1.3.

In other words, an excellent self-cleaning capability of the spark plug 1 can be secured by specifying the dimensional relationship of G2/G1≦1.5.

Second Embodiment

This embodiment provides a spark plug 1*a* that has almost the same structure as the spark plug 1 according to the first embodiment. Accordingly, only the difference in structure therebetween will be described below.

Figure 6:
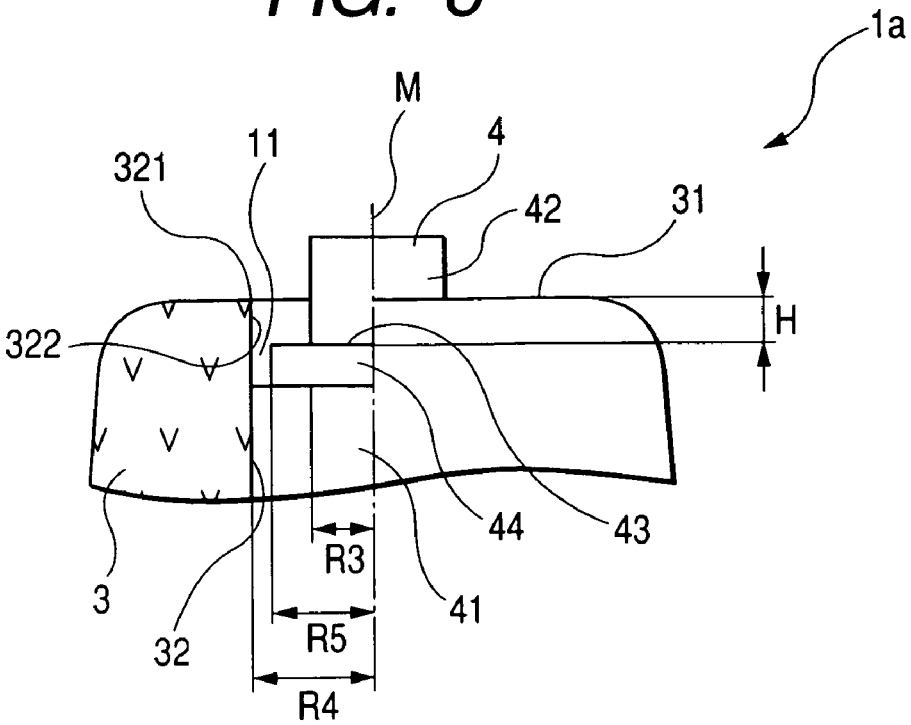
FIG. 6 is a partially cross-sectional side view showing an end portion of a spark plug according to the second embodiment of the invention.

Referring to FIG. 6, in the spark plug 1*a*, the base member 41 of the center electrode 4 has an end portion 44 that includes the end 43 of the base member 41.

The end portion 44 of the base member 41 has a diameter R5 that is less than the diameter R4 of the central bore 32 of the insulator 3 and greater than the diameter R3 of the thin member 42 of the center electrode 4 (i.e., R3<R5<R4).

Accordingly, there exists a gap 11 between the end portion 44 of the base member 41 and the inner surface 322 of the insulator 3. The width of the gap 11 (i.e., (R5−R4)) is, for example, in a range of 0.1 to 0.2 mm.

In the spark plug 1*a*, when the surface of the insulator 3 is fouled with carbon, sparks may be discharged between the end portion 44 of the base member 41 of the center electrode 4 and the outer edge 522 of the protruding member 52 of the ground electrode 5 without passing the inside area of the inner surface 322 of the insulator 3 which forms the gap 11 together with the end portion 44 of the base member 41.

However, the gap 11 is as narrow as described above, and thus it is difficult for carbon to deposit on the inside area of the inner surface 322 of the insulator 3.

Accordingly, the self-cleaning capability of the spark plug la can still be secured through burring off the carbon that has deposited on the outside area of the inner surface 322 of the insulator 3.

The above-described spark plug 1 a has the same advantages as the spark plug 1.

Third Embodiment

This embodiment provides a spark plug 1*b* that has almost the same structure as the spark plug 1 according to the first embodiment. Accordingly, only the difference in structure therebetween will be described below.

Figure 7:
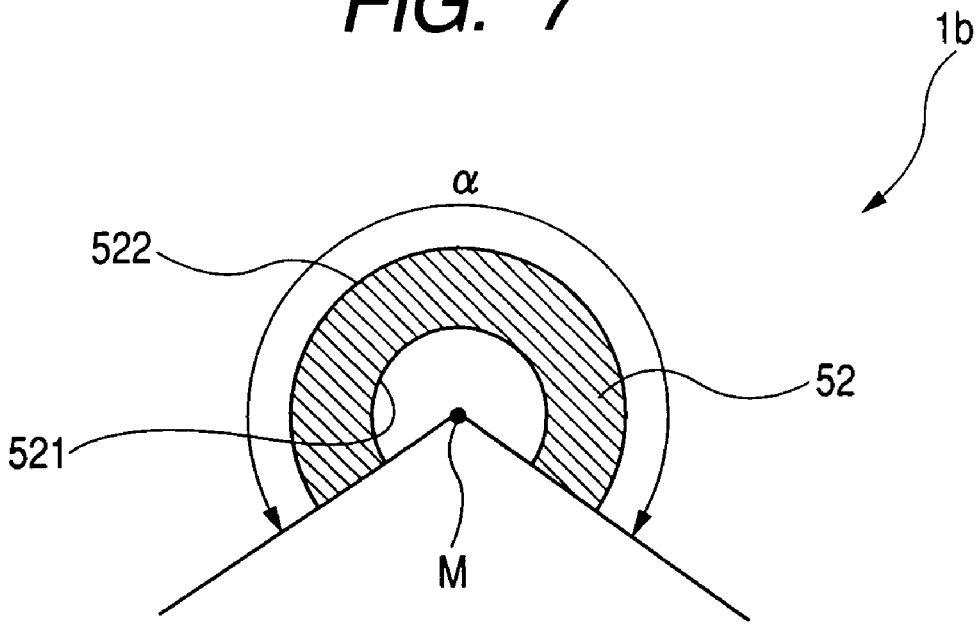
FIG. 7 is a cross-sectional view of a ground electrode protruding member of a spark plug according to the third embodiment of the invention.

Referring to FIG. 7, in the spark plug 1*b*, the protruding member 52 of the ground electrode 5 occupies an angular range a of approximately 260° about the axis M of the thin member 42 of the center electrode 4.

More specifically, in the spark plug 1*b*, the protruding member 52 of the ground electrode 5 is shaped in an incomplete cylindrical tube and thus the inner and outer edges 521 and 522 thereof each are shaped in an incomplete circle.

In addition, to provide the spark plug 1*b* with the same advantages as the spark plug 1, it is necessary for the angular range α to be not less than 120°.

Specifying the range of α as above, when the surface of the insulator 3 is fouled with carbon, it is possible for the spark plug 1*b* to effectively burn off the carbon on the surface of the insulator 3. As a result, the self-cleaning capability of the spark plug 1*b* can be secured.

The above range of a has been determined through the experiment to be described below.

EXPERIMENT 4

This experiment was conducted to determine the effect of the angular range α on the insulation resistance between the center electrode 4 and the ground electrode 5 of the spark plug 1*b*.

In this experiment, sample spark plugs, which had the same structure as the spark plug 1*b* but various α, were tested in the same way as in the Experiment 3. In addition, in all of those sample spark plugs, R1 was 0.6 mm, R2 was 1.4 mm, R3 was 0.3 mm, R4 was 1.2 mm, H was 0.6 mm, J was 0.2 mm, and L was 1.0 mm.

Figure 18:
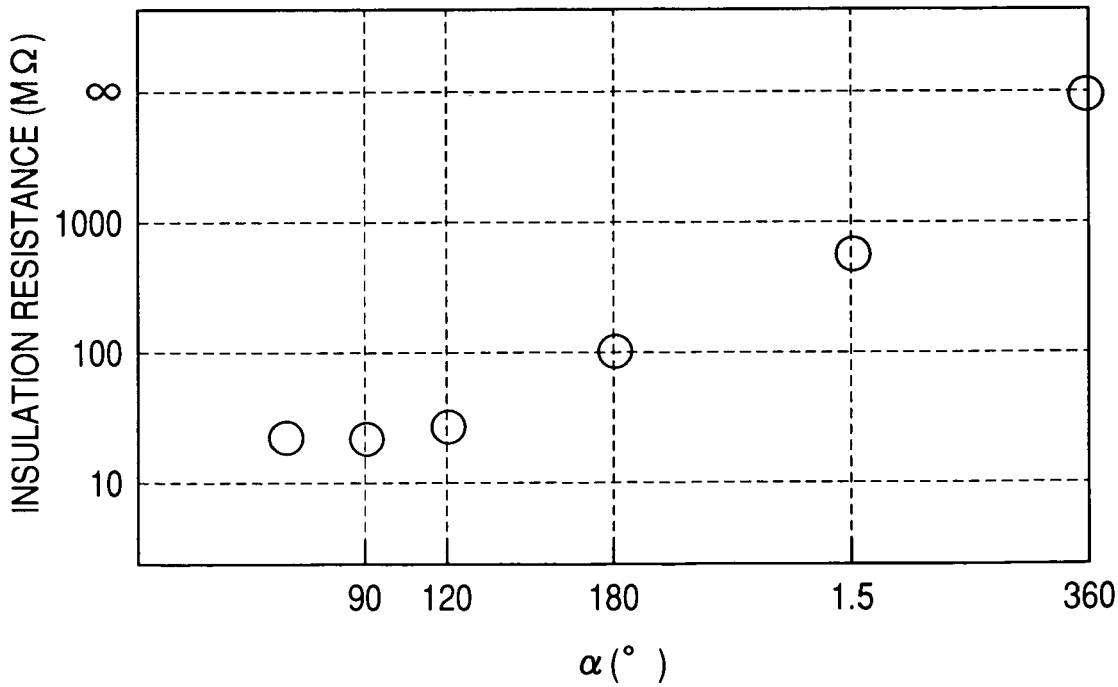
FIG. 18 is a graphical representation showing the relationship between the angular range $\alpha$ and the insulation resistance in the spark plug of FIG. 7.

FIG. 18 shows the test results, where the horizontal axis represents the angular range α, while the vertical one represents the insulation resistance.

It can be seen from FIG. 18 that the insulation resistance was large when the angular range α was greater than or equal to 120°.

In other words, the self-cleaning capability of the spark plug 1*b* can be secured by specifying the above range of α.

Fourth Embodiment

This embodiment provides a spark plug 1*c* that has almost the same structure as the spark plug 1 according to the first embodiment. Accordingly, only the difference in structure therebetween will be described below.

Figure 8:
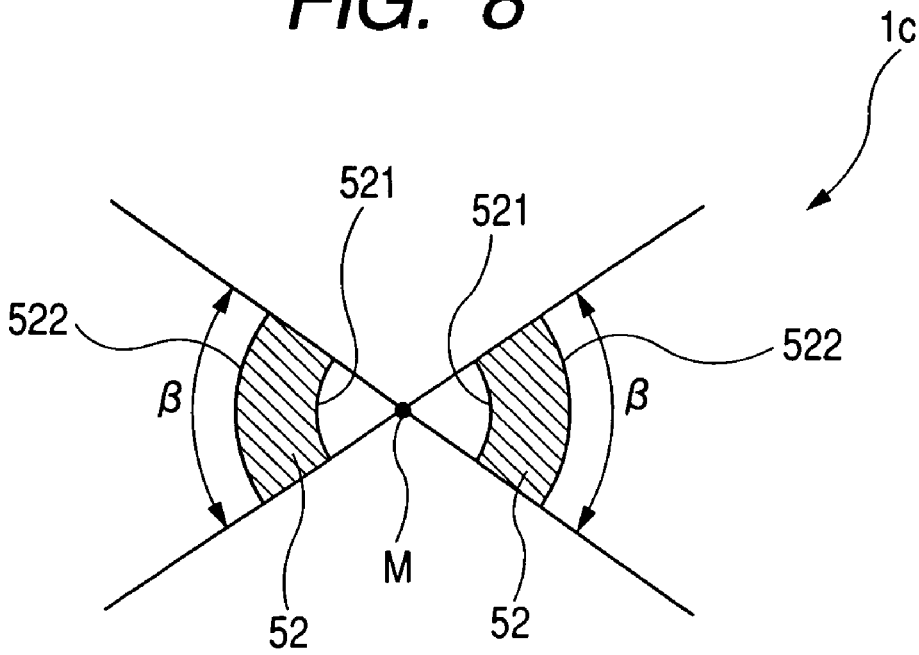
FIG. 8 is a cross-sectional view of a ground electrode protruding member of a spark plug according to the fourth embodiment of the invention.

Referring to FIG. 8, in the spark plug 1*c*, the protruding member 52 of the ground electrode 5 occupies only part of the circumference about the axis M of the thin member 42 of the center electrode 4.

More specifically, in the spark plug 1*c*, the protruding member 52 of the ground electrode 5 is divided into two separate parts which are symmetrically positioned on the circumference about the axis M of the thin member 42 of the center electrode 4 and each occupy an angular range β of approximately 80° about the axis M. In other words, the protruding member 52 as a whole occupies an angular range 2β of approximately 160° about the axis M.

The above angular range 262 corresponds to the angular range α defined in the third embodiment. Accordingly, to provide the spark plug 1*c* with the same advantages as the spark plug 1, it is necessary for the angular range 2β to be not less than 120°

Fifth Embodiment

This embodiment illustrates various shapes which the protruding member 52 of the ground electrode 5 may have.

As described previously, in the first embodiment, the protruding member 52 of the ground electrode 5 is shaped in a cylindrical tube.

However, the protruding member 52 of the ground electrode 5 may have various other shapes.

For example, referring to FIGS. 9A1 and 9A2, the protruding member 52 may be in the shape of a cylindrical rod that has a recess 523 centrally formed therein. The recess 523 is so shaped that it is a rectangle on an arbitrary hypothetical plane, which includes the axis of the protruding member 52, as shown in FIG. 9A1 and a circle on another hypothetical plane, which is perpendicular to the axis of the protruding member 52, as shown in FIG. 9A2. Consequently, both the inner and outer edges 521 and 522 of the protruding member 52 are circular in shape.

Referring to FIGS. 9B1 and 9B2, the protruding member 52 may also be in the shape of a square rod that has a recess 523 centrally formed therein and an extension 524 formed at a bottom end thereof. The recess 523 is so shaped that it is a parabola on an arbitrary hypothetical plane, which includes the axis of the protruding member 52, as shown in FIG. 9B1 and a circle on another arbitrary hypothetical plane, which is perpendicular to the axis of the protruding member 52, as shown in FIG. 9B2. Consequently, the inner edge 521 of the protruding member 52 has a circular shape, while the outer edge 522 of the same has a square shape. The extension 524 extends radially outward to protrude from the outer edge 522.

Referring to FIGS. 9C1 and 9C2, the protruding member 52 may also be in the shape of a frustoconical rod that has a recess 523 centrally formed therein. The recess 523 is so shaped that it is a triangle on an arbitrary hypothetical plane, which includes the axis of the protruding member 52, as shown in FIG. 9C1 and a square on another arbitrary hypothetical plane, which is perpendicular to the axis of the protruding member 52, as shown in FIG. 9C2. Consequently, the inner edge 521 of the protruding member 52 has a square shape, while the outer edge 522 of the same has a circular shape.

Referring to FIGS. 9D1 and 9D2, the protruding member 52 may also be in the shape of a rod that has an elliptical cross-section perpendicular to the axis thereof and a recess 523 formed therein. The recess 523 is so shaped that it is a rectangle on an arbitrary hypothetical plane, which includes the axis of the protruding member 52, as shown in FIG. 9D1 and a circle on another arbitrary hypothetical plane, which is perpendicular to the axis of the protruding member 52, as shown in FIG. 9D. Consequently, the inner edge 521 of the protruding member 52 has a circular shape, while the outer edge 522 of the same has an elliptical shape. In addition, the recess 523 is so positioned that the center of the recess 523 deviates from the axis of the protruding member 52.

Moreover, the depth N of all of the recesses 523 shown in FIGS. 9A1-9D2 is, preferably, in a range of 0.1 to 0.5 mm.

With the above-described and any other possible shapes of the protruding member 52, it is still possible to provide the spark plug 1 with the same advantages as with the cylindrical-tube shape.

Sixth Embodiment

This embodiment provides a spark plug 1*d* that has almost the same structure as the spark plug 1 according to the first embodiment. Accordingly, only the difference in structure therebetween will be described below.

Figure 10:
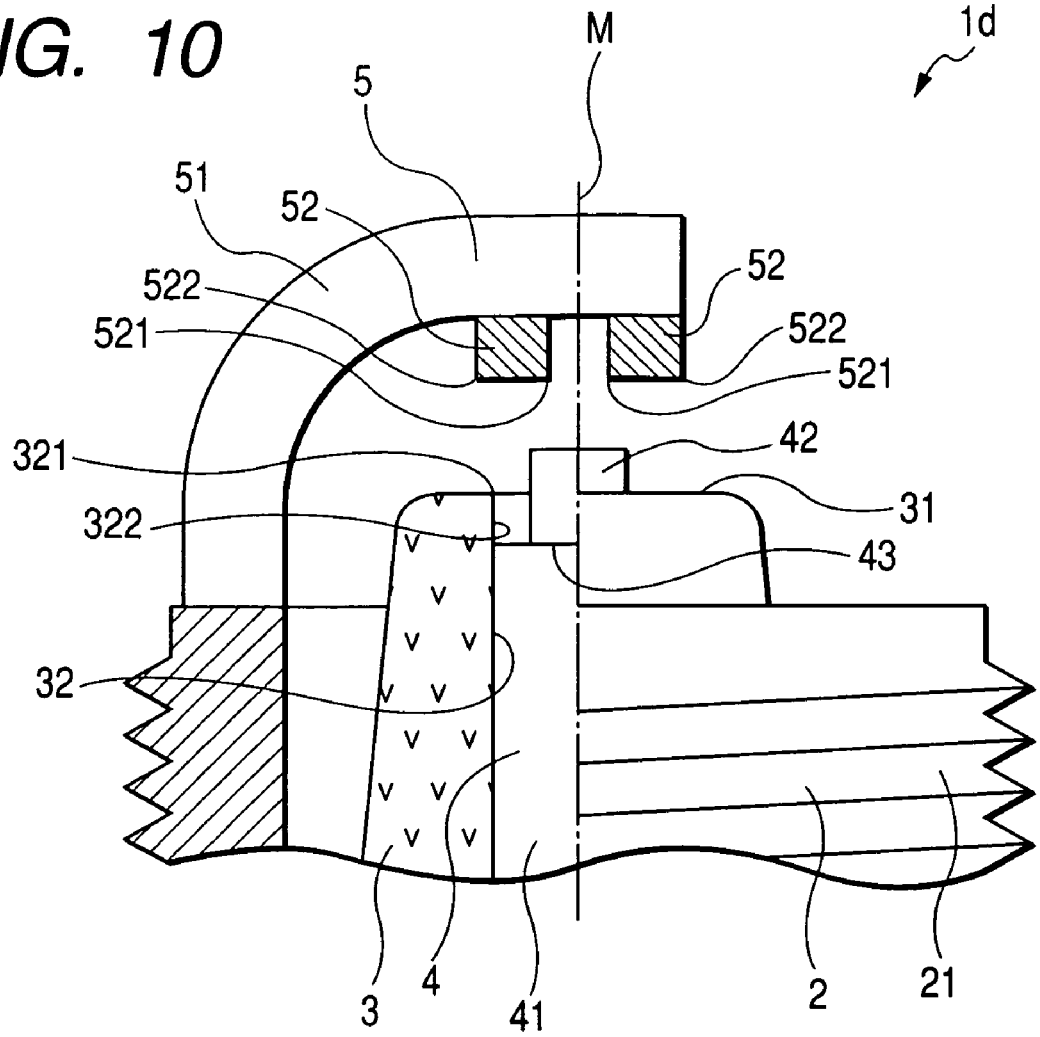
FIG. 10 is a partially cross-sectional side view showing an end portion of a spark plug according to the sixth embodiment of the invention.
Figure 11:
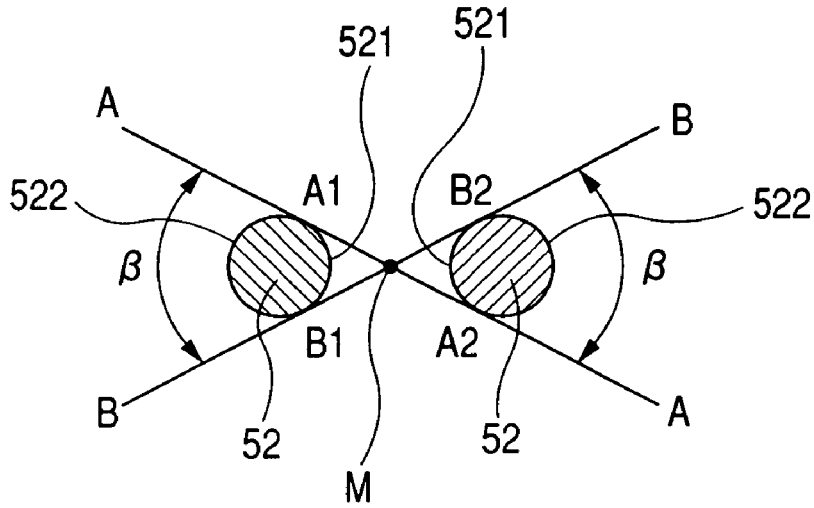
FIG. 11 is a cross-sectional view of ground electrode protruding members of the spark plug of FIG. 10.
Figure 12:
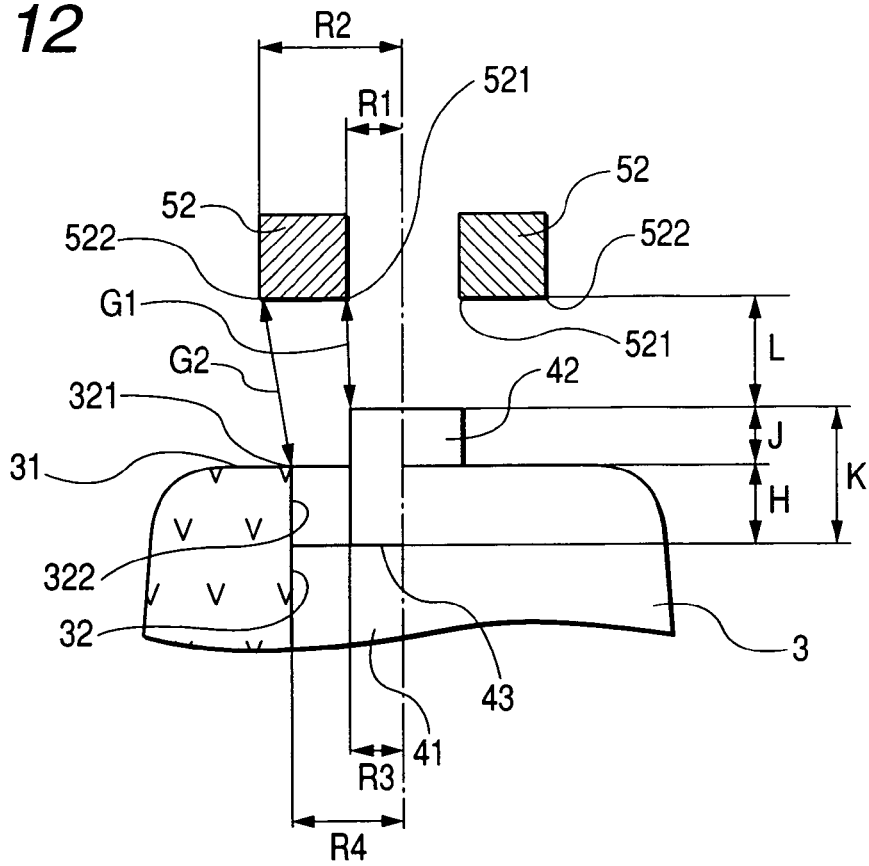
FIG. 12 is a partially cross-sectional side view illustrating dimensional parameters in the spark plug of FIG. 10.

Referring to FIGS. 10-12, in the spark plug 1*d*, the ground electrode 5 includes two protruding members 52 which are cylindrical in shape and symmetrically disposed with respect to the axis M of the thin member 42 of the ground electrode 4.

Each of the protruding members 52 has an inner edge 521 and an outer edge 522. More specifically, as shown in FIG. 11, a line A-A can be drawn which intersects the axis M of the thin member 42 of the center electrode 4 and is tangent to the end edges of the protruding members 52 respectively at points A1 and A2. Similarly, another line B-B can also be drawn which intersects the axis M and is tangent to the end edges of the protruding members 52 respectively at points B1 and B2. Consequently, for one protruding member 52, the end edge is divided into two circular arcs A1-B1, of which the one closer to the axis M represents the inner edge 521 of the protruding member 52, while the other represents the outer edge 522 of the same. Similarly, for the other protruding member 52, the arc A2-B2 closer to the axis M represents the inner edge 521 of the protruding member 52, while the other arc A2-B2 represents the outer edge 522 of the same.

In the spark plug Id, as shown in FIG. 12, the same dimensional relationships as in the spark plug 1 are specified. Moreover, the sum of the angular ranges of the protruding members 52 about the axis M (i.e., 2β) is at least 120°.

The above-descried spark plug 1*d* has the same advantages as the spark plug 1.

In addition, each of the protruding members 52 in the spark plug 1*d* may have, instead of the above cylindrical shape, any other possible shapes, such as a triangle or quadratic prism.

Seventh Embodiment

This embodiment provides a spark plug 1*e* that has almost the same structure as the spark plug 1 according to the first embodiment. Accordingly, only the difference in structure therebetween will be described below.

Figure 13:
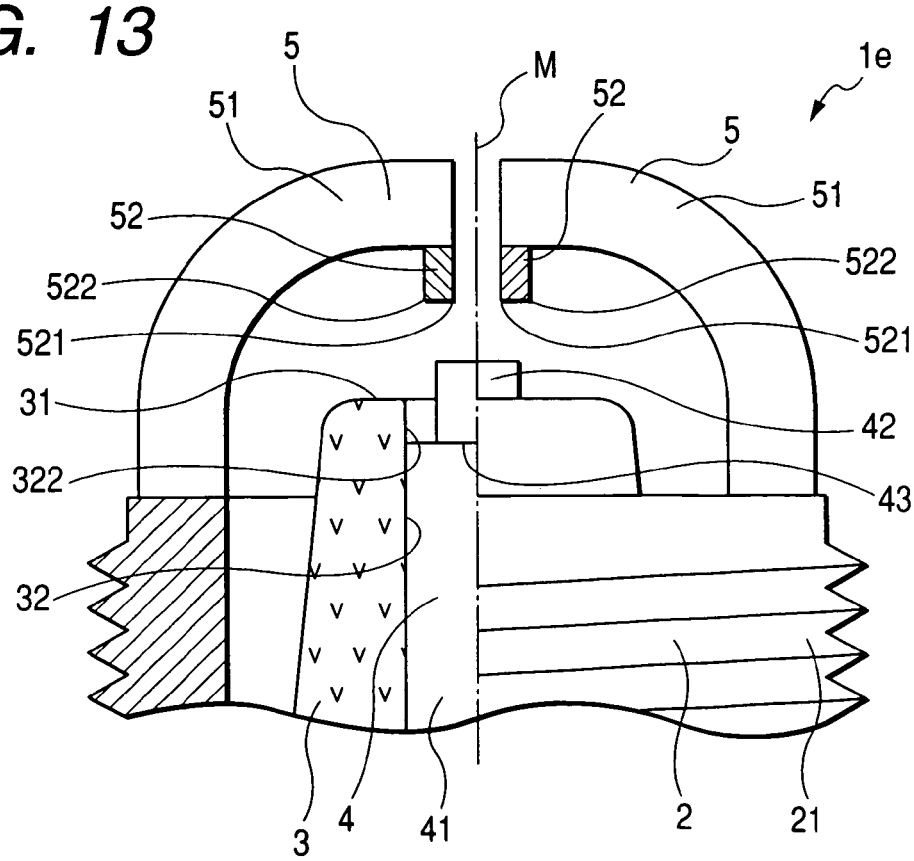
FIG. 13 is a partially cross-sectional side view showing an end portion of a spark plug according to the seventh embodiment of the invention.

Referring to FIG. 13, there are provided two ground electrodes 5 in the spark plug 1*e*. Each of the ground electrodes 5 includes a base member 51 and a protruding member 52.

The base members 51 of the ground electrodes 5 are so fixed to the metal shell 2 that they are spaced 180° from each other in the circumferential direction of the metal shell 2. The protruding members 52 of the ground electrodes 5 are cylindrical in shape and joined to the respective base members 51 such that the side surfaces of the protruding members 52 face one another with the axis M of the thin member 42 of the center electrode 4 lying therebetween.

In the spark plug 1*e*, the same dimensional relationships as in the spark plug 1 are specified. Consequently, the spark plug 1*e* has the same advantages as the spark plug 1.

While the above particular embodiments of the invention have been shown and described, it will be understood by those who practice the invention and those skilled in the art that various modifications, changes, and improvements may be made to the invention without departing from the spirit of the disclosed concept.

Such modifications, changes, and improvements within the skill of the art are intended to be covered by the appended claims.

What is claimed is:

1. A spark plug for an internal combustion engine comprising:

a metal shell;

an insulator retained in the metal shell, the insulator having an end, which protrudes from the metal shell, and a bore that extends in a longitudinal direction of the insulator and opens at the end of the insulator to form an inner edge of the insulator;

a center electrode including a base member and a thin member, the base member being fitted in the bore of the insulator and having an end that is positioned inside the bore of the insulator, the thin member being thinner than the base member and joined to the end of the base member, the thin member having an axis and an end edge that is a given distance away from the end of the base member in an axial direction of the thin member; and a ground electrode including a base member fixed to the metal shell and a protruding member joined to the base member, the protruding member protruding from a surface of the base member and having an end face that faces the thin member of the center electrode through a spark gap, the end face of the protruding member having an inner and an outer edge, the inner edge being positioned closer to the axis of the thin member of the center electrode than the outer edge, wherein, $$0.7\times R3\leqq R1,$$

$$0.5\times R4\leqq R2\leqq 1.2\times R4,$$

$$L\leqq G1\leqq 1.2\times L,$$

$$G1<G2+H, \text{ and}$$

$$G2/G1\leqq 1.5 \text{ where,}$$

R1 is a distance between the axis of the thin member of the center electrode and the inner edge of the protruding member of the ground electrode in a radial direction of the thin member, R2 is a distance between the axis of the thin member of the center electrode and the outer edge of the protruding member of the ground electrode in the radial direction of the thin member, R3 is a radius of the thin member of the center electrode at the end edge of the thin member, R4 is a radius of the bore of the insulator at the end of the insulator, G1 is a minimum distance between the end edge of the thin member of the center electrode and the inner edge of the protruding member of the ground electrode, G2 is a minimum distance between the inner edge of the insulator and the outer edge of the protruding member of the ground electrode, L is a distance between the thin member of the center electrode and the protruding member of the ground electrode in the axial direction of the thin member, and H is a distance between the end of the base member of the center electrode and the end of the insulator in the axial direction of the thin member of the center electrode, wherein the protruding member of the ground electrode has a tubular shape to form the inner edge at an inner circumference of the end face of the protruding member and the outer edge at an outer circumference of the same.

2. The spark plug as set forth in claim 1, wherein the protruding member of the ground electrode occupies an angular range of at least 120° about the axis of the thin member of the center electrode.

3. The spark plug as set forth in claim 1, wherein, $0.7 \times R3 \leqq R2$, and $0.5 \times R4 \leqq R1 \leqq 1.2 \times R4$.

4. The spark plug as set forth in claim 1, wherein the ground electrode further includes at least one protruding member having an end face that faces the thin member of the center electrode through the spark gap and has an outer edge and an inner edge positioned closer to the axis of the thin member of the center electrode than the outer edge.

5. The spark plug as set forth in claim 1, wherein, $G2/G1 \leqq 1.3$.

6. The spark plug as set forth in claim 1, wherein, $0.5 \times H \leqq (R4-R3)$.

7. The spark plug as set forth in claim 1, wherein, $0.1\ \text{mm} \leqq (R2-R1) \leqq 0.5\ \text{mm}$.

8. The spark plug as set forth in claim 1, wherein the protruding member of the ground electrode protrudes at least 0.3 mm from the surface of the base member of the ground electrode.

9. The spark plug as set forth in claim 1, wherein the base member of the center electrode has an end portion that is thicker than the thin member of the center electrode and thinner than the bore of the insulator and includes the end of the base member to which the thin member is joined.

10. The spark plug as set forth in claim 1, wherein the thin member of the center electrode is made of a noble metal, and wherein the thin member has a cross-sectional area perpendicular to the axis thereof in a range of 0.07 to 1.13 $mm^2$ and protrudes 0.3 to 1.5 mm from the end of the base member of the center electrode.

11. The spark plug as set forth in claim 10, wherein the noble metal is an Ir-based alloy that contains Ir in an amount of not less than 50% by weight and at least one additive and has a melting point of not lower than 2000 □.

12. The spark plug as set forth in claim 10, wherein the at least one additive is selected from Pt, Rh, Ni, W, Pd, Ru, Re, Al, $Al_2O_3$, Y, and $Y_2O_3$.

13. The spark plug as set forth in claim 1, wherein the protruding member of the ground electrode is made of a Pt-based alloy that contains Pt in an amount of not less than 50% by weight and at least one additive and has a melting point of not lower than 1500 □.

14. The spark plug as set forth in claim 13, wherein the at least one additive is selected from Ir, Rh, Ni, W, Pd, Ru, and Re.

15. The spark plug as set forth in claim 1, wherein the thin member of the center electrode protrudes from the end of the insulator.

16. The spark plug as set forth in claim 1, wherein the protruding member is shaped in an incomplete cylindrical tube to occupy an angular range of less than 360° about the axis of the thin member of the center electrode.

17. A spark plug for an internal combustion engine comprising:

a metal shell;

an insulator retained in the metal shell, the insulator having an end, which protrudes from the metal shell, and a bore that extends in a longitudinal direction of the insulator and opens at the end of the insulator to form an inner edge of the insulator;

a center electrode including a base member and a thin member, the base member being fitted in the bore of the insulator and having an end that is positioned inside the bore of the insulator, the thin member being thinner than the base member and joined to the end of the base member, the thin member having an axis and an end edge that is a given distance away from the end of the base member in an axial direction of the thin member; and a ground electrode including a base member fixed to the metal shell and a protruding member joined to the base member, the protruding member protruding from a surface of the base member and having an end face that faces the thin member of the center electrode through a spark gap, the end face of the protruding member having an inner and an outer edge, the inner edge being positioned closer to the axis of the thin member of the center electrode than the outer edge, wherein, $0.7 \times R3 \leqq R1$, $0.5 \times R4 \leqq R2 \leqq 1.2 \times R4$, $L \leqq G1 \leqq 1.2 \times L$, $G1 < G2 + H$, and $G2/G1 \leqq 1.5$ where, R1 is a distance between the axis of the thin member of the center electrode and the inner edge of the protruding member of the ground electrode in a radial direction of the thin member, R2 is a distance between the axis of the thin member of the center electrode and the outer edge of the protruding member of the ground electrode in the radial direction of the thin member, R3 is a radius of the thin member of the center electrode at the end edge of the thin member, R4 is a radius of the bore of the insulator at the end of the insulator, G1 is a minimum distance between the end edge of the thin member of the center electrode and the inner edge of the protruding member of the ground electrode, G2 is a minimum distance between the inner edge of the insulator and the outer edge of the protruding member of the ground electrode, L is a distance between the thin member of the center electrode and the protruding member of the ground electrode in the axial direction of the thin member, and H is a distance between the end of the base member of the center electrode and the end of the insulator in the axial direction of the thin member of the center electrode, wherein the base member of the center electrode has an end portion that is thicker than the thin member of the center electrode and thinner than the bore of the insulator and includes the end of the base member to which the thin member is joined.

* * * * *

UNITED STATES PATENT AND TRADEMARK OFFICE

CERTIFICATE OF CORRECTION

PATENT NO. : 7,541,724 B2
APPLICATION NO. : 11/395543
DATED : June 2, 2009
INVENTOR(S) : Okabe It is certified that error appears in the above-identified patent and that said Letters Patent is hereby corrected as shown below:

Claim 11, at column 17, line 43, "□" should be --°C-- (per original application claim 12, line 4).

Claim 13, at column 17, line 51, "□" should be --°C -- (per original application claim 14, line 5).

Signed and Sealed this

Fifth Day of January, 2010

David J. Kappos

David J. Kappos
*Director of the United States Patent and Trademark Office*